US012774531B2

(12) United States Patent
Suleiman et al.

(10) Patent No.: US 12,774,531 B2
(45) Date of Patent: Oct. 27, 2026

(54) HYBRID SOL-GEL COATINGS WITH WASTE-MATERIAL ADDITIVES FOR REDUCING CORROSION

(71) Applicant: KING FAHD UNIVERSITY OF PETROLEUM AND MINERALS, Dhahran (SA)

(72) Inventors: Rami K. Suleiman, Dhahran (SA); A Madhan Kumar, Dhahran (SA); Fadi A. Al-Badour, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 532 days.

(21) Appl. No.: 18/466,992

(22) Filed: Sep. 14, 2023

(65) Prior Publication Data

US 2025/0092530 A1 Mar. 20, 2025

(51) Int. Cl.

| | |
|---|---|
| ***C23F 11/18*** | (2006.01) |
| ***C23C 22/73*** | (2006.01) |
| ***C23F 11/10*** | (2006.01) |

(52) U.S. Cl.

CPC ..... *C23F 11/18* (2013.01); *C23C 22/73* (2013.01); *C23F 11/10* (2013.01); *C23C 2222/20* (2013.01)

(58) Field of Classification Search

None

See application file for complete search history.

(56) References Cited

U.S. PATENT DOCUMENTS

| | | | | |
|---|---|---|---|---|
| 4,407,864 | A | 10/1983 | Stift et al. | |
| 8,889,812 | B2 | 11/2014 | Albert et al. | |
| 10,533,113 | B2 | 1/2020 | Wu et al. | |
| 11,479,692 | B2 | 10/2022 | Suleiman et al. | |
| 2008/0111027 | A1* | 5/2008 | Blohowiak | C09D 5/08 528/25 |
| 2010/0178278 | A1* | 7/2010 | Luo | A61P 43/00 424/602 |
| 2018/0244978 | A1* | 8/2018 | Drees | C09K 8/524 |
| 2020/0079687 | A1* | 3/2020 | Bosgaerd | C03C 17/366 |
| 2021/0388212 | A1* | 12/2021 | Agustin Saenz | C23C 18/1216 |
| 2022/0145128 | A1* | 5/2022 | Duffy | C08G 77/58 |

FOREIGN PATENT DOCUMENTS

| | | |
|---|---|---|
| CN | 104437444 B | 8/2016 |
| JP | 2022-1358 A | 6/2022 |

OTHER PUBLICATIONS

Alyne Lamy-Mendes, et al., "Aerogel Composites Produced from Silica and Recycled Rubber Sols for Thermal Insulation", Materials, vol. 15, Issue 22, Nov. 8, 2022, pp. 1-14.

* cited by examiner

*Primary Examiner* — Joseph D Anthony

(74) *Attorney, Agent, or Firm* — Oblon, McClelland, Maier & Neustadt, L.L.P.

(57) ABSTRACT

A method of reducing corrosion, including coating a surface of a substrate with a corrosion inhibitor and drying to form a coated substrate. The coated substrate when contacted with a corrosive medium has a charge transfer resistance ($R_{ct}$) of at least 2,000 kΩ. The corrosion inhibitor includes a sol-gel and limestone. The sol-gel includes reacted units of amino-propyltriethoxysilane (APTES), tetraethyl orthosilicate (TEOS), dimethoxy-methyl-octadecylsilane (DMMOS), vinyltrimethoxysilane (VTMS), and zirconium (IV) propoxide.

20 Claims, 21 Drawing Sheets

HYBRID SOL-GEL COATINGS WITH WASTE-MATERIAL ADDITIVES FOR REDUCING CORROSION

STATEMENT OF PRIOR DISCLOSURE BY INVENTOR

Aspects of the present disclosure are described in R. K. Suleiman, A. Y. Adesina, O. N. Olalekan, A. M. Kumar, F. A. Al-Badour, and S. Subbaiah. "Influence of Waste Material Additives on the Performance of a Novel Hybrid Sol-Gel Coating on Mild Steel in 3.5% NaCl Medium"; Polymers; Jun. 27, 2023; 15, 2842, incorporated herein by reference in its entirety.

STATEMENT OF ACKNOWLEDGEMENT

Support provided by King Fahd University of Petroleum and Minerals (KFUPM) under grant number INAM2305 is gratefully acknowledged.

BACKGROUND

Technical Field

The present disclosure is directed to sol-gel coatings, and particularly, to hybrid sol-gel coatings modified with various waste material additives for reducing corrosion.

Description of the Related Prior Art

The description of the related prior art provided herein is for the purpose of generally presenting the context of the disclosure. Work of the presently named inventors, to the extent described in this background section, as well as aspects of the description which may not otherwise qualify as prior art at the time of filing, are neither expressly nor impliedly admitted as prior art against the present invention.

Mild steel is a major infrastructure component for various industries due to its high tensile and impact strengths, good ductility and weldability, and excellent malleability with cold-forming possibilities. However, this metallic substrate is prone to corrosion, especially in an aggressive marine environment. The dissolution of this metal in such harsh environments may be caused by solid corrosion products accumulated on its surface. The mitigation of the corrosion process on the steel surfaces has been achieved conventionally by applying chemical phosphate and chromate conversion coatings. However, there is a need for alternatives to these coatings due to their toxicity.

The corrosion protection of mild steel by hybrid sol-gel coatings has recently been considered. Hybrid sol-gel coatings are organic-inorganic hybrid (OIH) materials produced by a sol-gel synthesis process, allowing the combination of inorganic and organic components in a single phase. These coatings can provide a barrier effect that prevents contact between the metal substrate and the corrosive environment and active protection by incorporating corrosion inhibitors or sacrificial anodes. The synthesis of these hybrid materials involves the conversion of monomers (usually organometal alkoxides) into a colloidal solution (sol) that acts as the precursor for an integrated network (or gel) of either discrete particles or network polymers. The sol undergoes hydrolysis and polycondensation reactions, forming a gel-like network containing both liquid and solid phases. The gel then undergoes drying, which removes the solvent and causes shrinkage and densification of the network. The sol-gel process allows the fine control of the coating's chemical composition, morphology, and porosity and the incorporation of dopants or functional groups. Some advantages of hybrid sol-gel coatings are their low toxicity, environmental friendliness, good adhesion, low porosity, and high mechanical properties. However, a need for appropriately determining the processing conditions as well as the coating parameters is important during the sol-gel fabrication process to avoid the production of hybrid coatings of an undesired high porous structure or less integrity on the metal surface.

The functionalization of hybrid sol-gel coatings with additives is a strategy to enhance the performance and functionality of the coatings for various applications. Additives can be incorporated into the hybrid sol-gel network to inhibit corrosion, provide antimicrobial activity, superhydrophobicity, or other desired features. Some examples of additives that can be used in hybrid sol-gel coatings are inhibitive pigments, nanoparticles, bacterial strains, organic molecules, and inorganic compounds. In particular, mixing hybrid sol-gel coatings with waste material additives is a promising way to utilize waste materials and reduce the environmental impact of the coatings. These additives can be incorporated into the hybrid sol-gel network to modify the coatings' structure, morphology, or properties. However, the effects of waste material additives on the performance and functionality of the hybrid sol-gel coatings are poorly understood and provide unpredictable results. They may depend on the type, amount, and distribution of the additives, as well as the synthesis and processing conditions of the hybrid sol-gel system.

Although there are a few reports on sol-gel coatings with waste material additives, there still exists a need to develop hybrid sol-gel coatings with waste-material additives to improve anti-corrosion performance.

SUMMARY

In an exemplary embodiment, a method of reducing corrosion is described. The method includes coating a surface of a substrate with a corrosion inhibitor and drying to form a coated substrate. The coated substrate when contacted with a corrosive medium has a charge transfer resistance ($R_{ct}$) of at least 2,000 kΩ. The corrosion inhibitor includes a sol-gel, and limestone, wherein the sol-gel includes reacted units of aminopropyltriethoxysilane (APTES), tetraethyl orthosilicate (TEOS), dimethoxymethyl-octadecylsilane (DMMOS), vinyltrimethoxysilane (VTMS), and zirconium (IV) propoxide.

In some embodiments, the corrosion inhibitor further includes at least one additive selected from the group consisting of eggshells, activated carbon, rubber, and cement kiln dust.

In some embodiments, the limestone is a powder wherein particles of the powder have an average size of 1-10 micrometers (μm).

In some embodiments, the corrosion inhibitor includes 0.01-1 gram (g) of the limestone per milliliter (mL) of the sol-gel.

In some embodiments, the limestone is uniformly dispersed in the corrosion inhibitor on the coated substrate.

In some embodiments, the sol-gel comprises 15-25 mol. % APTES, 15-25 mol. % TEOS, 10-20 mol. % DMMOS, 25-35 mol. % VTMS, and 1-5 mol % zirconium (IV) propoxide, based on a total number of moles in the sol-gel.

In some embodiments, the corrosion inhibitor is stable up to 425° C.

In some embodiments, corrosion inhibitor forms a uniform and continuous layer on the coated substrate.

In some embodiments, corrosion inhibitor does not include water, free hydroxyl groups, or hydrogen bonds after the drying.

In some embodiments, the drying is performed for 1-24 hours at a temperature of 20-200° C.

In some embodiments, the corrosion inhibitor has an average thickness of 10 to 100 μm on the coated substrate.

In some embodiments, the coated substrate has a water contact angle (WCA) greater than 135°.

In some embodiments, the coated substrate has an average surface roughness of 1.5-2.5 μm.

In some embodiments, the coated substrate has an indentation hardness (HIT) at 50 millinewton (mN) of at least 10 MPa.

In some embodiments, the corrosion inhibitor does not include chromium or phosphate.

In some embodiments, the substrate is made from at least one material selected from the group consisting of mild steel, carbon steel, stainless steel, iron, copper, nickel, and alloys thereof.

In some embodiments, the corrosive medium includes an aqueous solution including at least one salt selected from the group consisting of an alkali metal salt, and an alkaline earth metal salt.

In some embodiments, the corrosive medium has a temperature of 30-70° C.

In some embodiments, the corrosion inhibitor increases the $R_{ct}$ by at least 10 times compared to a same method but without the limestone.

In some embodiments, the $R_{ct}$ is measured following contacting the coated substrate with the corrosive medium for at least 24 hours.

The foregoing general description of the illustrative embodiments and the following detailed description thereof are merely exemplary aspects of the teachings of this disclosure and are not restrictive.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

DETAILED DESCRIPTION

Figure 1:
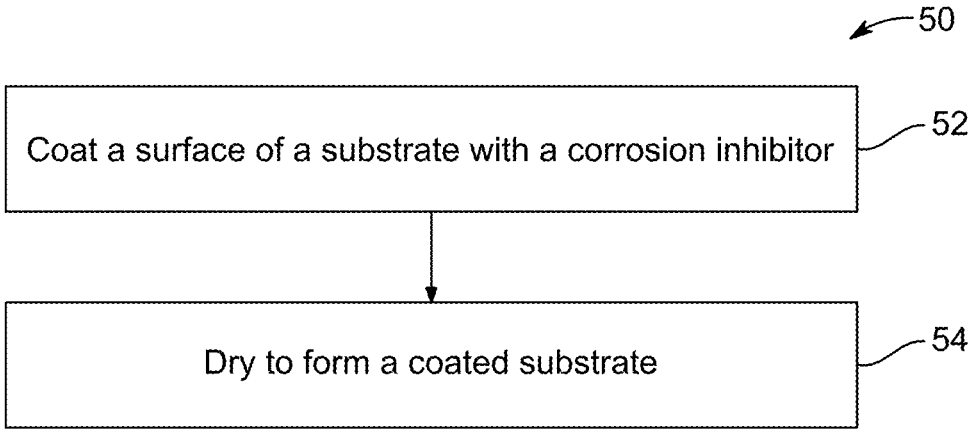
FIG. 1 is a flowchart depicting a method of reducing corrosion, according to certain embodiments.

When describing the present disclosure, the terms used are to be construed in accordance with the following definitions, unless a context dictates otherwise.

Embodiments of the present invention will now be described more fully hereinafter with reference to the accompanying drawings wherever applicable, in that some, but not all embodiments of the disclosure are shown.

In the drawings, like reference numerals designate identical or corresponding parts throughout the several views. Further, as used herein, the words "a," "an" and the like generally carry a meaning of "one or more," unless stated otherwise.

Where a numerical limit or range is stated herein, the endpoints are included. Also, all values and subranges within a numerical limit or range are specifically included as if explicitly written out.

Furthermore, the terms "approximately", "approximate", "about," and similar terms generally refer to ranges that include the identified value within a margin of 20%, 10%, or preferably 5%, and any values therebetween.

The use of the terms "include," "includes", "including," "have," "has," or "having" should be generally understood as open-ended and non-limiting unless specifically stated otherwise.

A weight percent of a component, unless specifically stated to the contrary, is based on the total weight of the formulation or composition in which the component is included. For example, if a particular element or component in a composition or article is said to have 5 wt %, it is understood that this percentage is in relation to a total compositional percentage of 100%.

As used herein, "sol-gel process" refers to a chemical synthesis method for materials, including resins, where an oxide network is developed through at least polycondensation reactions of a molecular precursor in a liquid. In the present disclosure, the molecular precursors are preferably silane derivatives (alkoxysilanes). The finished product of a sol-gel synthesis process can be referred to as a "sol-gel material", a "sol-gel", a "sol-gel processed material", a "sol-gel product," or a "sol-gel processed product".

As used herein, the term "curing" is a chemical process that creates a cured or hardened coating by generating cross-links within the polymers.

As used herein, "corrosion" refers to the conversion of materials, for instance, metals into more stable forms such as metal oxides. There are two main types of corrosion, general or uniform attack corrosion, and galvanic corrosion. Typical or uniform corrosion happens, for instance, when iron is in a humid environment, creating iron oxide and corroding. Galvanic corrosion occurs when two materials with differing bipolar indices or dislocations are in touch with each other or relatively close to one another when an electrolyte is present. The movement of electrons between materials is created by potential difference. In such a system, one material serves as the cathode and is more active (or less noble), while the other material serves as the anode and is less active (or more inert). The cathode corrodes more slowly than the anode, which corrodes rapidly.

As used herein, the term 'corrosive medium' refers to an environment that results in accelerated corrosion, such as acidic and high salt concentration environments.

As used herein, the term "corrosion inhibitor" refers to the chemical compound that, when added to a liquid or gas, decreases the corrosion rate of a material, typically a metal or an alloy, that meets the fluid. The effectiveness of a corrosion inhibitor depends on fluid composition, quantity of water, and flow regime.

As used herein, the term "additive" refers to a substance added in small amounts to another compound to improve, strengthen, or otherwise alter its properties.

As used herein, the term "sonication" refers to a process of applying sound energy to agitate particles or discontinuous fibers in a liquid.

As used herein, "water contact angle (WCA)" refers to a measure of the wettability of a solid surface. Hydrophobic solids have a WCA above 90° (indicative of poor wetting), and hydrophilic solids have a WCA below 90° (indicative of water-loving). The WCA is often used for gauging the extent of cleanliness of a surface.

Aspects of the present invention are directed toward inhibiting corrosion of a substrate by coating its surface with a hybrid sol-gel coating functionalized with various waste material additives. The coating is effective in preventing/reducing the corrosion of metals in contact with a corrosive medium.

FIG. 1 illustrates a flow chart of method 50 for reducing corrosion. The order in which the method 50 is described is not intended to be construed as a limitation, and any number of the described method steps can be combined in any order to implement the method 50. Additionally, individual steps may be removed or skipped from the method 50 without departing from the spirit and scope of the present disclosure.

At step 52, the method 50 includes coating a surface of a substrate with a corrosion inhibitor. In a preferred embodiment, the substrate is a metal surface. In some embodiments, the metal surface is part of a system. As used herein, "systems" include, but are not limited to, systems used in petroleum (e.g., crude oil and its products) or natural gas production, such as well casing, transport pipelines, drilling and other oil field applications, transport, separation, refining, storage, and other liquid natural gas and petroleum-related applications, geothermal wells, water wells; cooling water systems including open recirculating, closed, and once-through systems; cisterns and water collection or holding systems, solar water heating systems, boilers and boiler water systems or systems used in power generation, mineral process waters including mineral washing, flotation and benefaction; paper mill digesters, washers, bleach plants, white water systems and mill water systems; black liquor evaporators in the pulp industry; gas scrubbers and air washers; continuous casting processes in the metallurgical industry; air conditioning and refrigeration systems; building fire protection heating water, such as pasteurization water; water reclamation and purification systems; membrane filtration water systems; food processing streams and waste treatment systems as well as in clarifiers, liquid-solid applications, municipal sewage treatment systems; and industrial or municipal water distribution systems. In preferred embodiments, the metal surface is part of a system for oil or gas production, transportation, or refining.

In some embodiments, the substrate is made of at least one of mild steel, carbon steel, stainless steel, iron, copper, nickel, and alloys thereof. In a specific embodiment, the substrate is made from mild steel. As used herein, the term 'alloy' refers to the mixture of two or more elements in which the main component is usually a metal. The alloy may include but are not limited to aluminum, titanium, and magnesium alloys. The metal may exhibit a crystal structure such as a body-centered cubic (bcc), face-centered cubic (fcc), and hexagonal close-packed (hcp) structure.

Steel is an alloy of iron and carbon that is widely used in construction and other applications because of its high tensile strength and low cost. Carbon, other elements, and inclusions within iron act as hardening agents that prevent the movement of dislocations that naturally exist in the iron atom crystal lattices. The carbon in typical steel alloys may contribute up to 2.1% of its weight. Steels can be broadly categorized into four groups based on their chemical compositions: carbon steels, alloy steels, stainless steels, and tool steels. Carbon steels contain trace amounts of alloying elements and account for 90% of total steel production. Carbon steels can be further categorized intro three groups depending on their carbon content: low carbon steels/mild steels contain up to 0.3% carbon, medium carbon steels contain 0.3-0.6% carbon, and high carbon steels contain more than 0.6% carbon. Alloys steels contain alloying elements (e.g. manganese, silicon, nickel, titanium, copper, chromium and aluminum) in varying proportions in order to manipulate the steel's properties, such as its hardenability, corrosion resistance, strength, formability, weldability or ductility. Stainless steels generally contain between 10-20% chromium as the main alloying element and are valued for high corrosion resistance. With over 11% chromium, steel is about 200 times more resistant to corrosion than mild steel. These steels can be divided into three groups based on their crystalline structure: austenitic steels, ferritic steels and martensitic steels. Tool steels contain tungsten, molybdenum, cobalt and vanadium in varying quantities to increase heat resistance and durability, making them ideal for cutting and drilling equipment.

In one embodiment, the metallic substrate comprises steel, carbon steel, low carbon steel, mild steel, medium carbon steel, high carbon steel, alloy steel, stainless steel, austenitic steel, ferritic steel, martensitic steel, tool steel, or mixtures thereof. Preferably, the metallic substrate comprises carbon steel. Most preferably the metallic substrate is a carbon steel with a carbon content of 0.05-1.0%, for example, API 5L×grade steel such as X52, X56, X60, X65, X70 to X120, N-80, J55, P-110, T-95, C1018, QT 800, and HS80, and other steel alloys such as 13Cr, 25Cr, Inconel 825, and 316 L.

The method involves coating the metallic substrate with the corrosion inhibitor composition prior to immersion into a corrosive environment. In some embodiments, the metal surface is partially coated with at least one layer, preferably 1-10 layers, 2-9, 3-8, 4-7, or 5-6 layers of the corrosion inhibitor before contacting the metal surface and the corrosion inhibitor in the corrosive medium. The coating may be done by any suitable method known in the art such as drop-casting, spin-coating, using an automatic coating machine, doctor blading, or brushing. In some embodiments, the coating has a thickness of 1-100 μm, preferably 10-90 μm, 20-80 μm, 30-70 μm, 40-60 μm, or about 50 μm.

The corrosion inhibitor includes a sol-gel. In some embodiments, the sol-gel includes reacted units of at least one silicate compound and a zirconium precursor. In some embodiments, the at least one silicate compound is $Si(OR^1)_3R^2$, where $R^1$ is a straight or branched alkyl group having 1-12 carbon atoms, preferably 2-11, 3-10, 4-9, 5-8, or 6-7 carbon atoms, and $R^2$ is an thiol, halide (Cl, Br or I), amine or hydroxyl functionalized alkyl group having 1-12 carbon atoms, preferably 2-11, 3-10, 4-9, 5-8, or 6-7 carbon atoms, wherein the thiol, halide, amine or hydroxyl is at a terminal end of the alkyl group. Examples include but are not limited to aminopropyltriethoxysilane (APTES), (3-aminopropyl) trimethoxysilane, (3-aminopropyl)tripropoxysilane, (3-chloropropyl)trimethoxysilane, or (3-mercaptopropyl) trimethoxysilane.

In some embodiments, the at least one silicate compound is $Si(OR^3)_4$, where $R^3$ is a straight or branched alkyl group having 1-12 carbon atoms, preferably 2-11, 3-10, 4-9, 5-8, or 6-7 carbon atoms. Examples include but are not limited to tetramethyl orthosilicate, tetraethyl orthosilicate (TEOS), or tetrapropyl orthosilicate (TEOS).

In some embodiments, the at least one silicate compound is $Si(OR^4)_2R^5R^6$, where $R^4$ is a straight or branched alkyl group having 1-12 carbon atoms, preferably 2-11, 3-10, 4-9, 5-8, or 6-7 carbon atoms, $R^5$ and $R^6$ are the same or different and are a straight or branched alkyl group having 1-30 carbon atoms, preferably 2-29, 3-28, 4-27, 5-26, 6-25, 7-24, 8-23, 9-22, 10-21, 11-20, 12-19, 13-18, 14-17, or 15-16 carbon atoms. Examples include but are not limited to dimethoxy-methyl-octadecylsilane (DMMOS), dimethoxydimethylsilane, or diethoxydimethylsilane.

In some embodiments, the at least one silicate compound is $Si(OR^7)_3R^8$, where $R^7$ is a straight or branched alkyl group having 1-12 carbon atoms, preferably 2-11, 3-10, 4-9, 5-8, or 6-7 carbon atoms, and $R^8$ is a straight or branched alkyl group having 1-12 carbon atoms, preferably 2-11, 3-10, 4-9, 5-8, or 6-7 carbon atoms having at least one double bond, wherein the double bond is a terminal vinyl double bond. Examples include but are not limited to vinyltrimethoxysilane (VTMS), or triethoxyvinylsilane.

In some embodiments, the zirconium precursor is a zirconium (IV) precursor. In an embodiment, the zirconium precursor has a formula of $Zr(OR^9)_4$, where $R^9$ is a straight or branched alkyl group having 1-12 carbon atoms, preferably 2-11, 3-10, 4-9, 5-8, or 6-7 carbon atoms.

Examples include but are not limited to zirconium (IV) methoxide, zirconium(IV) ethoxide zirconium(IV) propoxide, zirconium(IV) butoxide, or zirconium(IV) tertbutoxide In some embodiments, the sol-gel includes reacted units of aminopropyltriethoxysilane (APTES), tetraethyl orthosilicate (TEOS), dimethoxy-methyl-octadecylsilane (DMMOS), vinyltrimethoxysilane (VTMS), and zirconium(IV) propoxide. In some embodiments, the sol-gel includes 15-25 mol % APTES, preferably 16-24, 17-23, 18-22, 19-21 mol. % APTES, 15-25 mol. % TEOS, preferably 16-24, 17-23, 18-22, 19-21 mol. % TEOS, 10-20 mol. % DMMOS, preferably 11-19, 12-18, 13-17, 14-16 mol. % DMMOS, 25-35 mol. % VTMS, preferably 25-35, 26-34, 27-33, 28-32, 29-31 mol. % VTMS, and 1-5 mol. % zirconium(IV) propoxide, preferably 1-5, 2-4 mol. % zirconium(IV) propoxide, based on the total number of moles in the sol-gel. In a preferred embodiment, the sol-gel includes 23.41 mol. % APTES, 24.49 mol. % TEOS, 13.06 mol. % DMMOS, 35 mol. % VTMS, and 3.65 mol. % zirconium(IV) propoxide, based on the total number of moles in the sol-gel.

The corrosion inhibitor further includes an additive. In a preferred embodiment, the additive is a waste material, such as a material that is a byproduct of another process which would be disposed of. Thereby making the current method economically and environmentally friendly. In some embodiments, the additive is derived from various sources such as, limestone, eggshells, activated carbon, rubber, and cement kiln dust. In some embodiments, the corrosion inhibitor may include a combination of the additives. In a preferred embodiment, the additive is limestone.

In some embodiments, the limestone is a powder. The particles of the limestone powder have an average size of 1-10 μm, preferably 2-9, preferably 3-8, preferably 4-7, and preferably 5-6 μm. In some embodiments, the limestone is uniformly dispersed in the sol-gel and corrosion inhibitor on the coated substrate.

In some embodiments, the additive includes 0.1-1 g of the additive per 10 mL of the sol-gel, preferably 0.12-0.95 g, preferably 0.15-0.9 g, preferably 0.15-0.85 g, preferably 0.2-0.8 g, preferably 0.2-0.7 g, preferably 0.2-0.7 g, preferably 0.2-0.65 g, preferably 0.2-0.6 g, and preferably 0.2-0.5 g of the additive per 10 mL of the sol-gel.

In some embodiments, the corrosion inhibitor is stable up to a temperature range of 120-500° C., preferably 180-480° C., preferably 200-460° C., preferably 250-450° C., preferably 300-450° C., preferably 400-450° C., preferably 425° C. In a preferred embodiment, the thermal stability of the corrosion inhibitor functionalized with an additive is higher than the thermal stability of the corrosion inhibitor without an additive.

Common examples of corrosion inhibitors include chromates, phosphates, polyaniline, conducting polymers, and a broad range of particularly fabricated chemicals that resemble surfactants. In some embodiments, the corrosion inhibitor does not contain chromium (Cr) or phosphate, as these coatings may be carcinogenic and toxic.

At step 54, the method 50 includes drying to form a coated substrate. In some embodiments, the drying is for 1-24 h, preferably 2-23 h, preferably 3-22 h, preferably 4-21 h, preferably 5-20 h, preferably 6-19 h, preferably 7-18 h, preferably 8-17 h, preferably 9-16 h, preferably 10-15 h, preferably 11-14 h, and preferably 12-13 h at a temperature of 20-200° C., preferably 25-195° C., preferably 30-190° C., preferably 35-185° C., preferably 40-180° C., preferably 45-175° C., preferably 50-170° C., preferably 55-165° C., preferably 60-160° C., preferably 65-155° C., preferably 70-150° C., preferably 75-145° C., preferably 80-140° C., preferably 85-145° C., preferably 90-140° C., preferably 95-135° C., preferably 100-130° C., preferably 105-125° C., and preferably 110-120° C.

In some embodiments, the corrosion inhibitor does not include water, free hydroxyl groups, or hydrogen bonds after the drying. It is indicative of a complete degree of hydrolysis, condensation, or dehydration of the developed sol-gel systems.

In a preferred embodiment, the corrosion inhibitor forms a uniform and continuous layer on the substrate. In an embodiment, particles of the corrosion inhibitor form a monolayer on the substrate. In another embodiment, the particles of the corrosion inhibitor may form more than a single layer on the substrate. The coated substrate is substantially free of coating delamination, pores, or cracks on the surfaces of the cured coating layers.

The method includes contacting the coated substrate with a corrosive medium. In some embodiments, the corrosive medium includes an aqueous solution including at least one salt selected from the group consisting of an alkali metal salt, and an alkaline earth metal salt. In an embodiment, the corrosive medium includes brine. "Brine" includes NaCl salt water as well as water containing other salts such as KCl, NaCl, KBr, $CaBr_2$ $CaCl_2$), ZnBr, $NaBr_2$, etc. A brine may be unsaturated or saturated with salt(s). Suitable examples of corrosive medium include sodium hydroxide (NaOH), potassium hydroxide (KOH), sodium chloride (NaCl), and potassium chloride (KCl). In a preferred embodiment, the corrosive medium is 3.5 wt. % NaCl solution. In some embodiments, the corrosive medium has a temperature of 30-70° C., preferably 35-65° C., preferably 40-60° C., and preferably 45-55° C.

In some embodiments, the coated substrate when contacted with a corrosive medium has a charge transfer resistance ($R_{ct}$) of at least 2,000 kΩ, preferably 2,000-3,000 kΩ, 2,100-2,900 kΩ, 2,200-2,800 kΩ, 2,300-2,700 kΩ, 2,400-2,600 kΩ, or about 2,500 kΩ. The Rt is measured following contacting the coated substrate with the corrosive medium for at least 24 hours, preferably 36, 48, 60, 72, 100, 500 or 1,000 hours. In an embodiment, the $R_{ct}$ is measured following contacting the coated substrate with the corrosive medium for 4 weeks. In a preferred embodiment, a limestone-modified hybrid coating sample has a $R_{ct}$ of 2160 kΩ, when contacted with the corrosive medium for 24 h. In another preferred embodiment, the limestone modified sample has a $R_{ct}$ of 2510 kΩ, when contacted with the corrosive medium for 4 weeks. In an embodiment, the corrosion inhibitor increases the $R_{ct}$ by at least 10 times compared to the same method but without the limestone additive, i.e., only the sol-gel.

As used herein 'charge transfer resistance ($R_{ct}$)' is a measure of the difficulty encountered when an electron is shifted from one atom or compound to another atom or compound. The charge transfer resistance is a function of the electrochemical corrosion reactions intensity at the coating/metal interface. A higher value of $R_{ct}$ implies a higher integrity of the coating system and then the slower development of corrosion reactions under the coatings.

In some embodiments, the coated substrate has a water contact angle (WCA) of greater than 135°, preferably in a range of 135-150°, preferably 137-148°, 139-146°, 141-144° or about 142°. In a preferred embodiment, the sol-gel coating material modified with limestone additive has a WCA of about 142°.

In some embodiments, the coated substrate has an average surface roughness of 1.5-2.5 μm, preferably 1.6-2.4 μm, preferably 1.7-2.3 μm, preferably 1.8-2.2 μm, preferably 1.9-2.1 μm. In some embodiments, the coated substrate has an indentation hardness (HIT) at 50 mN of at least 10 MPa, preferably 10-20 MPa, 12-18 MPa, or 14-16 MPa. In a specific embodiment, the limestone additive sample has the HIT of 15.357 MPa at 50 mN.

While not wishing to be bound to a single theory, it is thought that a synergistic relationship between the limestone additive and the sol-gel in the corrosion inhibitor causes an enhancement of the roughness, hydrophobicity, and adhesion of the coating thereby improving its mechanical strength, electrical conductivity, and thermal stability properties. These properties are all improved over a coating with only the sol-gel and no limestone additive. Further, not all additives achieve the improved performance, therefore, the synergism depends on the type, amount, and distribution of the additives, as well as the synthesis and processing conditions.

EXAMPLES

The following examples demonstrate the anti-corrosion performance of sol-gel coatings functionalized with waste materials, as described herein. The examples are provided solely for illustration and are not to be construed as limitations of the present disclosure, as many variations thereof are possible without departing from the spirit and scope of the present disclosure.

Example 1: Materials

Aminopropyltriethoxysilane (APTES), tetraethyl orthosilicate (TEOS), dimethoxy-methyl-octadecylsilane (DMMOS), zirconium(IV) propoxide (70% in 1-propanol), and ethanol absolute (EtOH) were obtained from Sigma-Aldrich, USA. Vinyltrimethoxysilane (VTMS) was obtained from Gelest Company (USA). All chemicals utilized in this study were of analytical grade and used without further purification. The tested waste material additives were ordered from various local sources.

Example 2: Synthesis of the Parent Hybrid Coating

The parent hybrid polymeric sol-gel material (herein labeled "C") was prepared by mixing 10 mL of each of the precursors TEOS (9.33 g, 0.045 mol), APTES (9.46 g, 0.043 mol), DMMOS (8.60 g, 0.024 mol), VTMS (9.68 g, 0.065 mol), and 3 mL (2.19 g, 0.0067 mol) of the zirconium(IV) propoxide precursor. The formation of the various inorganic polymeric networks in the hybrid polymer (via the hydrolysis/polycondensation reactions) was initiated by the dropwise addition of 1 mL of a 2:1 mixture of absolute ethanol-0.05 N HNO3 under continuous stirring. The resulting homogeneous polymeric solution was aged for 1 day in a closed beaker and room temperature (RT) before modifying it with waste material additives.

Example 3: Preparation of the Waste Additives-Loaded Hybrid Coatings

The parent hybrid coating C was individually functionalized using five different waste-material additives. This was achieved by loading 10 mL of the parent coating (C) with an amount of each micronized waste material listed in Table 1. The waste-modified solutions were sonicated using an ultrasonic probe (Vibracell, Sonics, USA) for a time to avoid any rapid agglomeration of the modified coating formulation.

TABLE 1

Details on the as-prepared coating matrices.

| Sample Code | Additive (amount in g) | Sonication Time (in min.) | Curing methodology (time in h) |
|---|---|---|---|
| C | — | — | RT (2) |
| C-AC | Activated carbon (0.25) | 0.5 | Oven (24) |
| C-CM | Cement (0.2) | 2.5 | RT (6) |
| C-EG | Eggshell (0.5) | 5 | Oven (24) |
| C-LM | Limestone (0.2) | 2.5 | RT (6) |
| C-RB | Tires rubber (0.5) | 5 | Oven (24) |

Example 4: Surface Preparation of the Mild Steel Substrates

The commercially available mild steel Q-panels (part no. S-36, Q-Lab Company, Westlake, OH 44145, USA, 3×6×0.032-inch dimension) with the chemical composition (in wt. %) [Mn (0.60% max), C (0.15% max), P (0.030% max), S (0.035% max), and Fe (remaining)] was used as a metallic substrate. The surface of the steel panels was washed with absolute ethanol and finally dried under RT before the deposition of the coating formulations.

Example 5: Deposition of Functional Coatings

Figure 2:
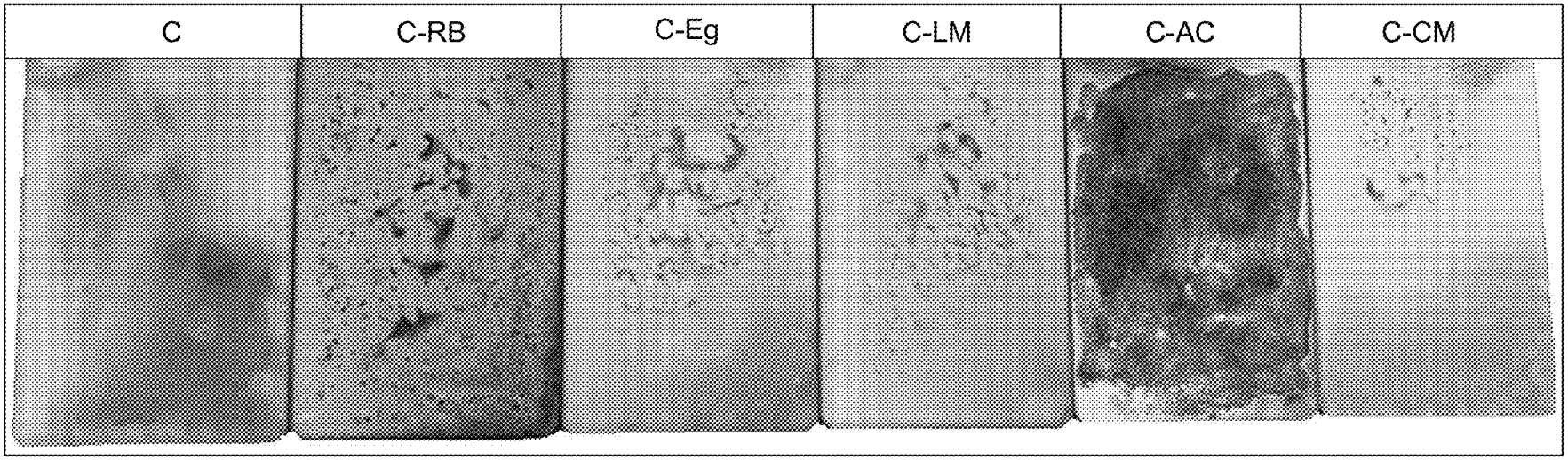
FIG. 2 shows pictures of parent hybrid sol-gel polymer "C", and C-functionalized with various waste material additives, namely, activated carbon (C-AC), cement (C-CM), eggshells (C-EG), limestone (C-LM), and tires rubber (C-RB) mild steel-coated matrices after curing, according to certain embodiments.

The C-coatings matrices were applied to the dried steel panels using the brush technique, and the resultant uniform coatings on steel were cured using a curing methodology and time listed in Table 1. An approximate and controlled thickness of 50-μm of the dry coating was formed on the panels' surface. No sign of coating delamination, pores, or cracks was visually observed on the surfaces of the cured coating layers of all formulations on the steel surface. However, the modification step with the waste additives resulted in various degrees of inhomogeneity behavior on the surface of the cured samples, especially for the rubber and activated carbon additives (FIG. 2).

Example 6: Characterization of Coatings Techniques

The structural characterization of the C-coating formulations was analyzed by a Thermo Scientific Nicolet IS5 Fourier Transformed Infrared Spectrometer using the Attenuated total reflection (ATR) mode and in the observation range of 600-3600 $cm^{1}$ (manufactured by Thermo Scientific, Waltham, Massachusetts, United States). The thermal degradation behavior of the cured coating layers on mild steel substrates was investigated using the TA SDT650 simultaneous thermal analyzer (TA instruments, 159 Lukens Drive, New Castle, DE 19720, USA) under a nitrogen flow of 200 mL $min^{-1}$ and a heating rate of 20° C. $min^{-1}$ up to 690° C.

The surfaces of the deposited coatings on mild steel were morphologically characterized using a scanning electron microscope (SEM) JEOL JSM-6610 LV coupled with an energy-dispersive X-ray spectrometer (EDS) (manufactured by JEOL, Akishima, Tokyo, Japan). Static water contact angle (WCA) measurements were performed at room temperature using an optical contact angle meter (Biolin Scientific, Theta lite, Finland). A 5 l drop of distilled water was deposited on different positions of the surface of cured coated samples. Three measurements were performed on each sample, and the mean values were recorded. An optical profilometer (Profilm 3D, Filmetrics, USA) was used to measure the microscale roughness of the surfaces. Three images with a pixel resolution of 1632×786 were obtained from different locations on the samples to calculate the surface roughness values. The quantification of "surface roughness" can be performed using a selection of different parameters, such as the root mean square height of the surface (Rq), maximum height of peaks (Rp), maximum depth of valleys (Rv), Maximum peak to value height (Rpv), and arithmetic average height of the surface (Ra).

The anti-corrosive performance assessment of the C-coating formulations on mild steel panels after 24 h and 4 weeks of exposure to 3.5 wt. % NaCl solution was achieved using electrochemical impedance spectroscopy (EIS) (Gamry Reference 620 potentiostat/galvanostat, USA). The experimental EIS data of the coated samples were simulated using the Echem Analyst software (version 6.04). The EIS measurements were conducted at the open circuit potential (OCP), a frequency range of 100 kHz-10 mHz, and a perturbation voltage of 10 mV. These experiments were conducted in a typical three-electrode cell with the coated AA3003 sample as a working electrode, a graphite rod as the counter electrode, and the saturated calomel electrode (SCE) as the reference electrode. The masked area of the sample exposed to the saline solution was 10 $cm^2$.

The nanoindentation hardness was performed on a STEP 500 Instrument Indentation Measurement System from Anton Paar Instruments, Switzerland. A Berkovich diamond indenter was used with a normal load of 50 mN for 10 s dwelling time. The equipment accuracy was very high, and the measurement was repeated nine times on each sample. The scratch test was conducted using the standard Rockwell diamond indenter with a 100 m tip radius. The indenter was pressed against the coating with an initial applied load of 30 mN and then pulled across the coating surface with progressive loading until the maximum applied load of 10 N was attained. The scratch test parameters utilized over a scanning length of 5 mm were a 2.5 N $min^{-1}$ loading rate and a 1.25 mm $min^{-1}$ scratch traverse speed, respectively. The normal load, penetration depth, acoustic emission (AE), frictional force, and coefficient of friction (COF) were measured during the test.

Example 7: Characterization of Coatings

The hybrid material was fabricated at room temperature and pressure via hydrolysis and polycondensation of organically functionalized silane and zirconium(IV) propoxide precursors. The APTES precursor helped the hybrid polymer to crosslink further at room temperature, while Zr induces more toughness in the hybrid polymer. Adding ethanol also enhanced the miscibility of the precursors and water, which induces more homogeneity in the final hybrid polymeric solution. The coatings were then subjected to structural, thermal, morphological, corrosion protection, and scratch resistance tests.

Figure 3:
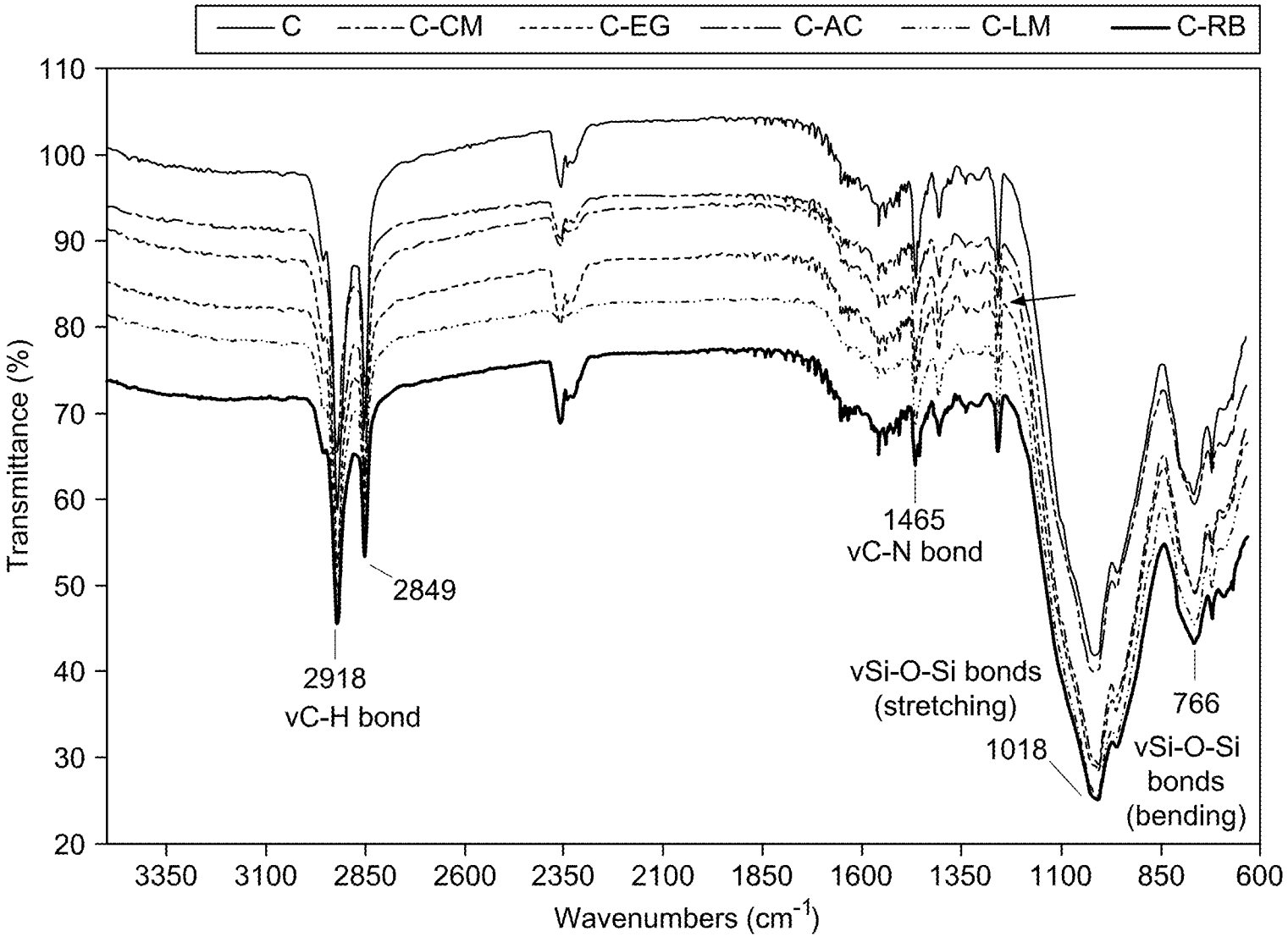
FIG. 3 shows Fourier-transform infrared spectroscopy (FTIR) spectra of neat (C) and waste material-modified hybrid sol-gel polymers, namely, C-AC, C-CM, C-EG, C-LM, and C-RB, according to certain embodiments.

The structural characterization of the base and waste material-modified hybrid polymers was attained by the Fourier-transform infrared spectroscopy (FTIR) analysis. This technique can provide information about the chemical bonds, molecular structure, and composition of the hybrid sol-gel network. It can also reveal the presence and amount of organic and inorganic components and their interactions and transformations during the sol-gel process and subsequent treatments. The FTIR spectra of all coating matrices prepared in this study are presented in FIG. 3.

The formation of the Si—O—Si inorganic network in the polymer network was deduced from the strong peak at 1081 $cm^{-1}$ in all spectra. The presence of a small adjacent peak at 950 $cm^{-1}$ corresponds to the Si—O—C stretching vibrations, which indicates the formation of covalent bonds between the organic and inorganic phases or the presence of different types of siloxane units, such as Qn (where n is the number of bridging oxygens), Tn (where n is the number of non-bridging oxygens), or Dn (where n is the number of geminal oxygens) in the hybrid polymer. The two peaks at 2849 and 2918 $cm^{-1}$ in the spectra of "C" are attributed to the C—H stretching vibrations, which indicates the presence of different types of organic groups in the hybrid sol-gel network. The absence of any broad peak in the 3200-3600 $cm^{-1}$ region in the spectra ascribed to the O—H stretching vibrations reveals the absence of any amount of water, free hydroxyl groups, or hydrogen bonds in the cured hybrid sol-gel network. This indicates a complete degree of hydrolysis, condensation, or dehydration of the developed sol-gel systems. Therefore, the modification step of the parent hybrid polymer with waste additives did not induce any significant change in its FTIR spectra, revealing a composite nature for the modified polymers.

Figure 4:
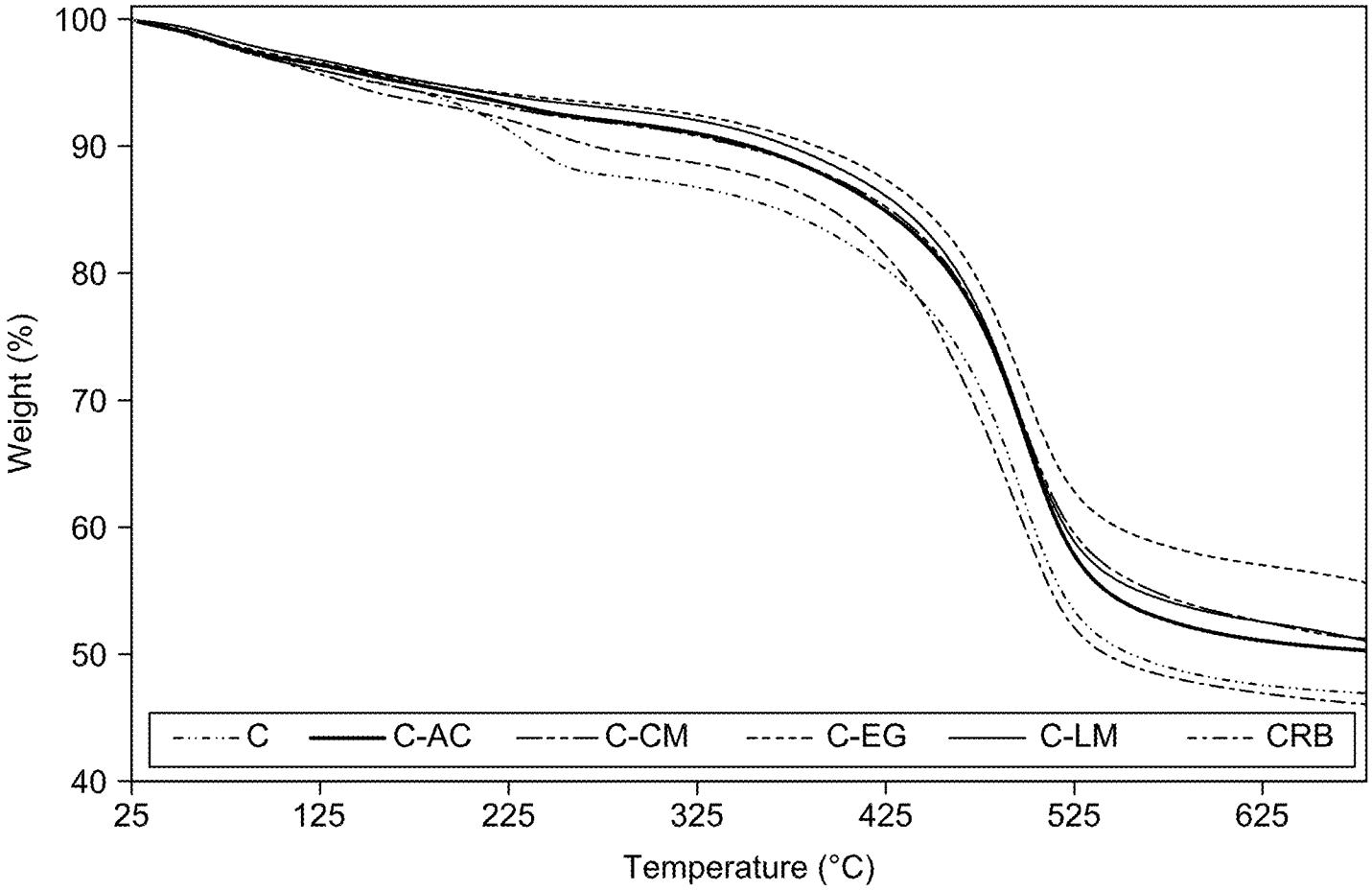
FIG. 4 shows thermogravimetric analysis (TGA) plots of various mild-steel-coated matrices, according to certain embodiments.

The thermal properties of the cured neat polymer, as well as the waste-modified composite materials, were analyzed by TGA. This technique can provide information on the thermal stability, decomposition, and weight loss of the hybrid sol-gel network. The TGA profiles of all coating matrices depicted in FIG. 4 show that all the waste additives (except for the tire rubber) have increased the thermal stability of the parent hybrid polymer. The samples modified with eggshell and limestone additives showed comparable weight loss behaviors (FIG. 4). The parent polymeric material (sample C) exhibited more degradation behavior between 200 to 300° C. compared with the modified polymer, which reveals the occurrence of either ethanol/water evaporation or further condensation in the inorganic polymeric network.

Figure 5:
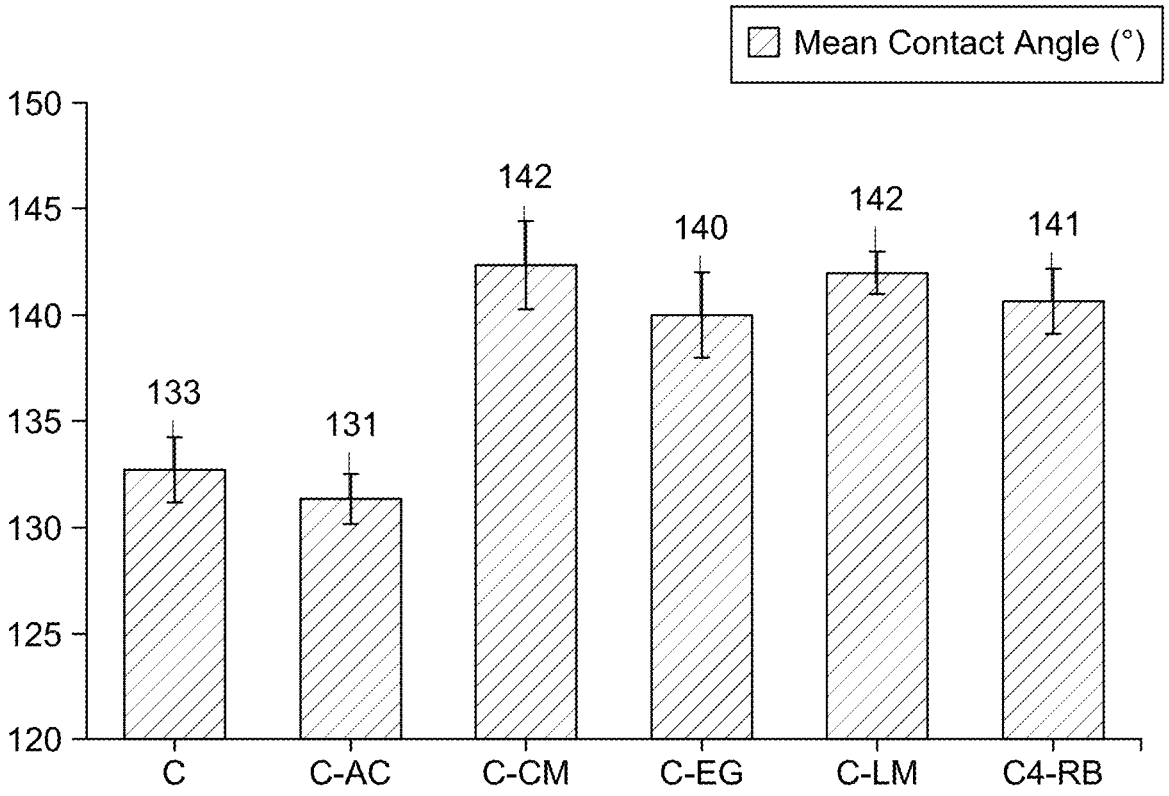
FIG. 5 shows water contact angle (WCA) values (in degrees (°)) of various cured matrices on a mild steel substrate, according to certain embodiments.
Figure 6A:
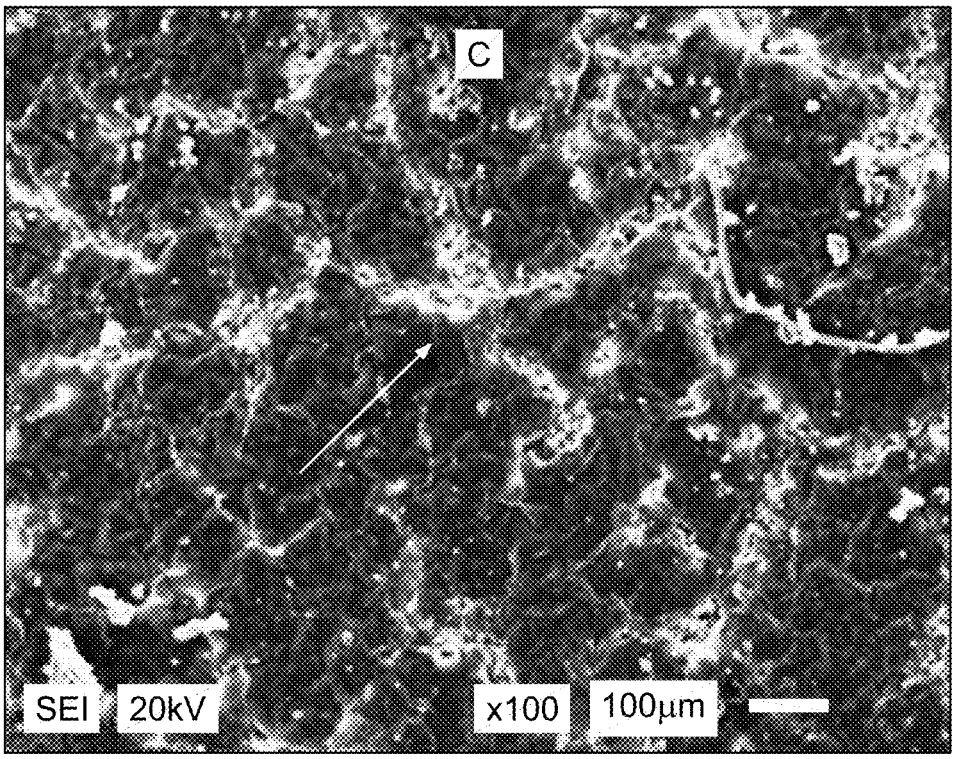
FIG. 6A shows a scanning electron microscope (SEM) micrograph of C, according to certain embodiments.
Figure 6B:
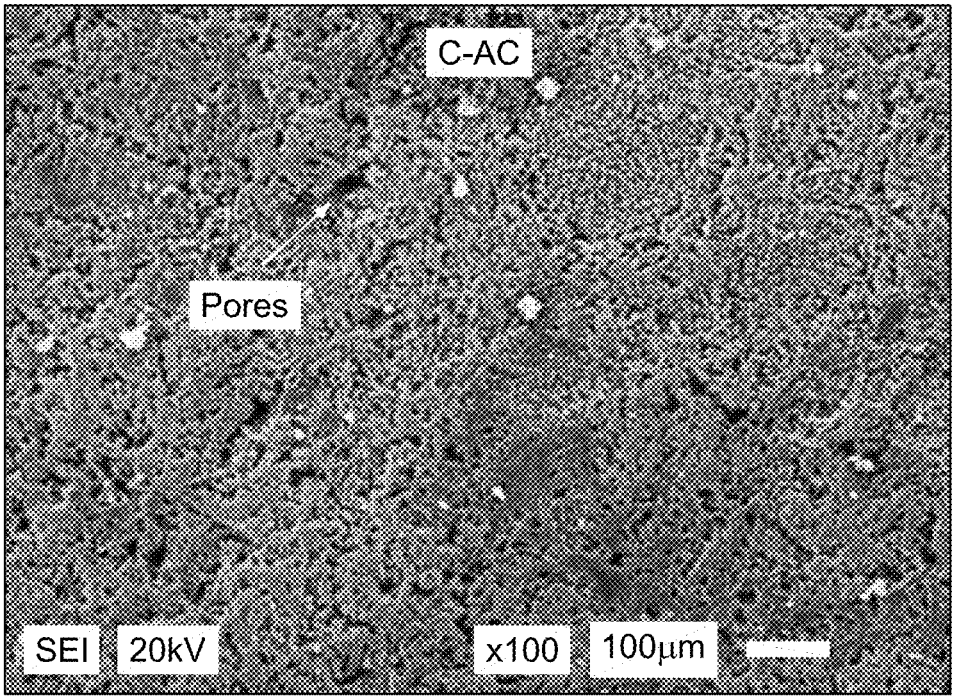
FIG. 6B shows a SEM micrograph of the C-AC coating material on the mild steel substrate, according to certain embodiments.
Figure 6C:
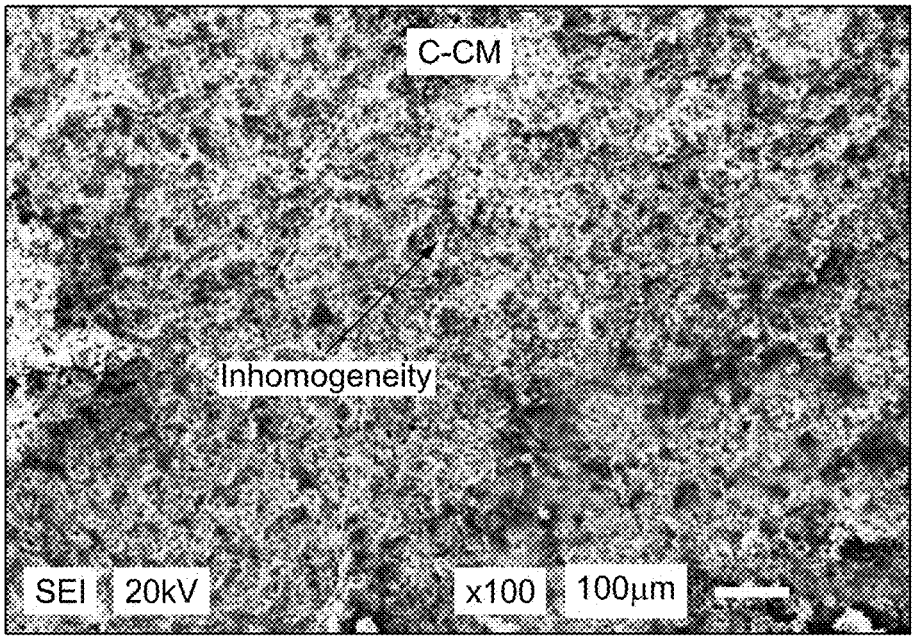
FIG. 6C shows a SEM micrograph of the C-CM coating material on the mild steel substrate, according to certain embodiments.
Figure 6D:
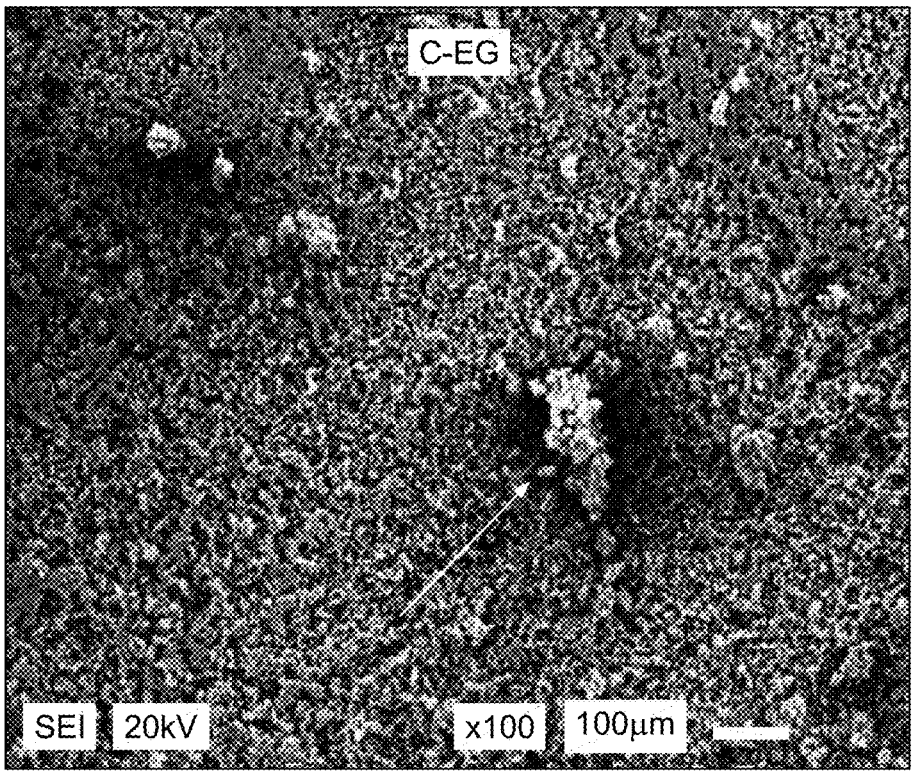
FIG. 6D shows a SEM micrograph of the C-EG coating material on the mild steel substrate, according to certain embodiments.
Figure 6E:
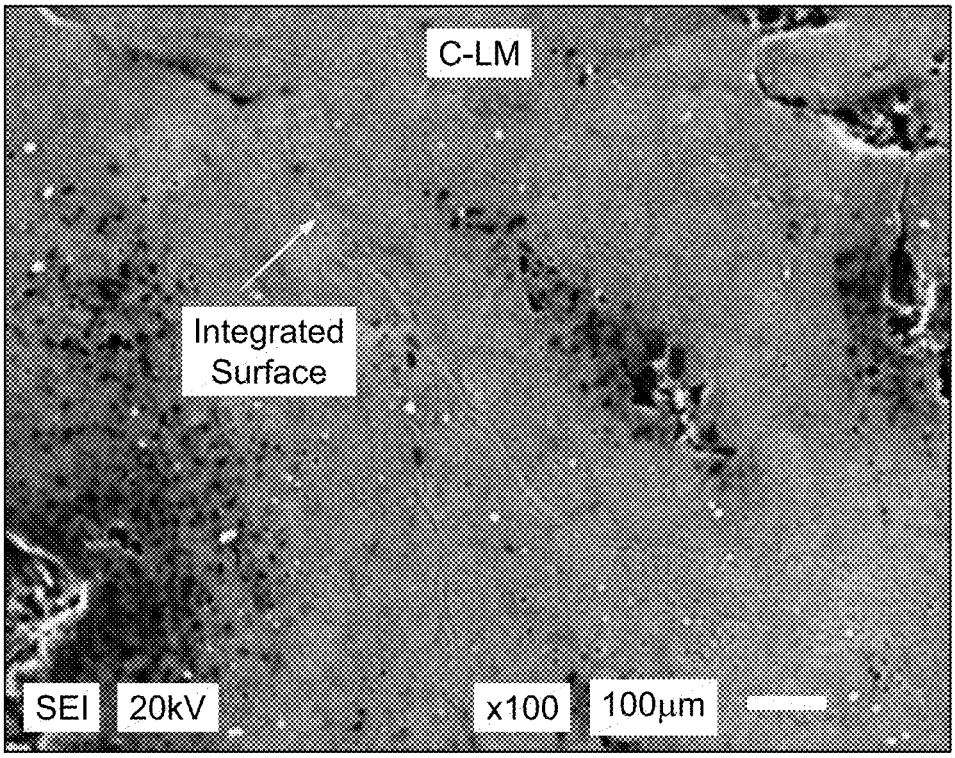
FIG. 6E shows a SEM micrograph of the C-LM coating material on the mild steel substrate, according to certain embodiments.
Figure 6F:
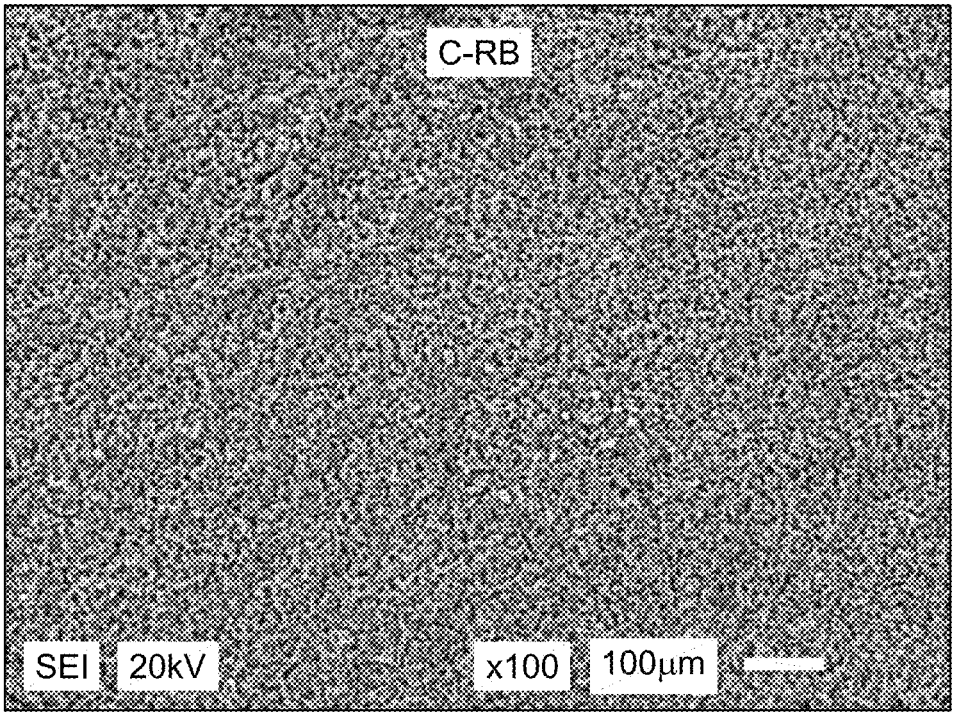
FIG. 6F shows a SEM micrograph of the C-RB coating material on the mild steel substrate, according to certain embodiments.

Morphological characteristics can affect the optical, mechanical, chemical, and functional properties of the hybrid sol-gel coatings, such as transparency, adhesion, corrosion resistance, or hydrophobicity. To get insight into the hydrophilic/hydrophobic properties of the cured parent hybrid coating "C" and the waste-modified ones, the coated samples were analyzed on steel using the WCA measurements, and the obtained values are depicted in FIG. 5. The data in FIG. 5 revealed hydrophobic properties for all coating matrices prepared in this work (WCA>130°), which can be attributed to the DMMOS silane precursor that has a long C18 alkyl chain in its chemical structure and characterized by low surface energy properties. Moreover, loading patent hybrid polymer matrix with waste additives yielded a minor enhancement (WCA~140°) in the hydrophobic properties of these coatings. This is explained by the change in the surface roughness properties described below.

The shape and integrity of the developed cured coated matrices on steel panels were analyzed by the SEM technique, and the obtained top-surface images are presented in FIG. 6. The images depicted a high degree of inhomogeneity on the surface of samples C, C-EG, and C-CM, while some pores can be seen on the surface of samples C-AC and C-RB. The surface of the coating layer modified with the limestone additive (C-LM) was the only one that showed an appreciated level of continuity and integrity on the steel surface, which indicates more compatibility for this additive with the parent hybrid polymer than other additives.

Optical profilometry was used to determine the surface roughness of the parent and waste-modified coatings on steel. This technique provides information about the surface topography and texture of the hybrid sol-gel coatings. Optical profilometry measures the surface height variations and the surface roughness parameters, such as the root mean square height of the surface (Rq), maximum height of peaks (Rp), maximum depth of valleys (Rv), maximum peak to value height (Rpv), and arithmetic average height of the surface (Ra). The obtained roughness parameters for all samples are listed in Table 2. A comparison of the surface roughness between the base "C" and waste-containing coating matrices on steel (Table 2) show that the modification step resulted in a moderate increase in the roughness of all samples except for sample C-AC which showed a drastic change in its surface roughness behavior. The roughness values for all samples are in the micrometer scale, which indicates a moderate co-solubility behavior for the waste additives (except the activated carbon) with the polymeric matrix of the base hybrid coating. The lowest Rpv value for sample C-LM indicates a high degree of film smoothness for this coating on the steel surface. The increase in the surface roughness of the waste-functionalized steel-coated samples also contributes to enhancing the hydrophobic properties of these samples.

TABLE 2

Roughness parameters (Mean ± STD) of unmodified and waste material-modified coatings.

| Sample | Ra (μm) | Rq (μm) | Rp (μm) | Rv (μm) | Rpv (μm) |
|---|---|---|---|---|---|
| C | 1.891 ± 0.263 | 2.415 ± 0.247 | 13.655 ± 1.01 | 32.270 ± 3.286 | 45.925 ± 16.746 |
| C-AC | 5.408 ± 0.817 | 7.524 ± 0.111 | 10.801 ± 1.678 | 35.100 ± 6.616 | 45.901 ± 8.297 |
| C-CM | 2.214 ± 0.456 | 2.982 ± 0.702 | 6.467 ± 0.837 | 19.260 ± 5.073 | 25.727 ± 8.339 |
| C-EG | 2.103 ± 0.326 | 2.866 ± 0.356 | 6.876 ± 0.902 | 21.950 ± 2.510 | 28.826 ± 2.385 |

TABLE 2-continued

Roughness parameters (Mean ± STD) of unmodified and waste material-modified coatings.

| Sample | Ra (μm) | Rq (μm) | Rp (μm) | Rv (μm) | Rpv (μm) |
|---|---|---|---|---|---|
| C-LM | 2.136 ± 0.313 | 2.719 ± 0.357 | 7.724 ± 1.553 | 13.637 ± 1.724 | 21.360 ± 10.044 |
| C-RB | 2.596 ± 0.512 | 3.370 ± 0.621 | 8.221 ± 0.702 | 26.518 ± 6.422 | 34.738 ± 6.002 |

Ra: arithmetic average height of the surface; Rq: root mean square height of the surface; Rp: maximum height of peaks; Rv: maximum depth of valleys; and Rpv: Maximum peak to value height; STD: Standard Deviation.

The mechanical strength, wear resistance, and durability of the hybrid sol-gel coatings was assessed by the indentation hardness measurements. This analysis provides information on the resistance of the hybrid sol-gel coatings to permanent deformation or penetration by an indenter. The hardness properties of hybrid sol-gel coatings are versatile to various factors such as the chemistry of precursors, preparation conditions, and the modification of the hybrid sol-gel coating systems with functional additives. The elastic indentation modulus (EIT) and the indentation hardness (HIT, at 50 mN) of parent and waste-modified coatings on steel are summarized in Table 3. The modification of the parent hybrid sol-gel coating with the activated carbon and tire rubber resulted in a reduction in its hardness properties, caused by the imparting of more organic content to the hybrid polymer by the two additives. Opposite to this behavior, the other additives enhanced the hardness properties of the parent coating because of their higher inorganic material content. The highest hardness properties were found for the C-LM sample. On the other hand, the low hardness properties for the C-RB sample indicate a negative impact of this additive on the mechanical strength, densification, or dispersion of this hybrid sol-gel network.

TABLE 3

Elastic indentation modulus ($E_{IT}$) and the indentation hardness ($H_{IT}$, at 50 mN) of unmodified and waste material-modified coating matrices on the steel surface.

| | $E_{IT}$ [GPa] | | $H_{IT}$ [MPa] | |
|---|---|---|---|---|
| Samples | Average | STD | Average | STD |
| C | 0.554 | 0.049 | 4.460 | 0.389 |
| C-AC | 0.426 | 0.063 | 13.137 | 2.5413 |
| C-CM | 1.351 | 0.101 | 5.1005 | 1.654 |
| C-EG | 1.255 | 0.171 | 4.044 | 1.184 |
| C-LM | 2.373 | 0.105 | 15.357 | 3.435 |
| C-RB | 0.202 | 0.030 | 3.351 | 0.691 |

Figure 7A:
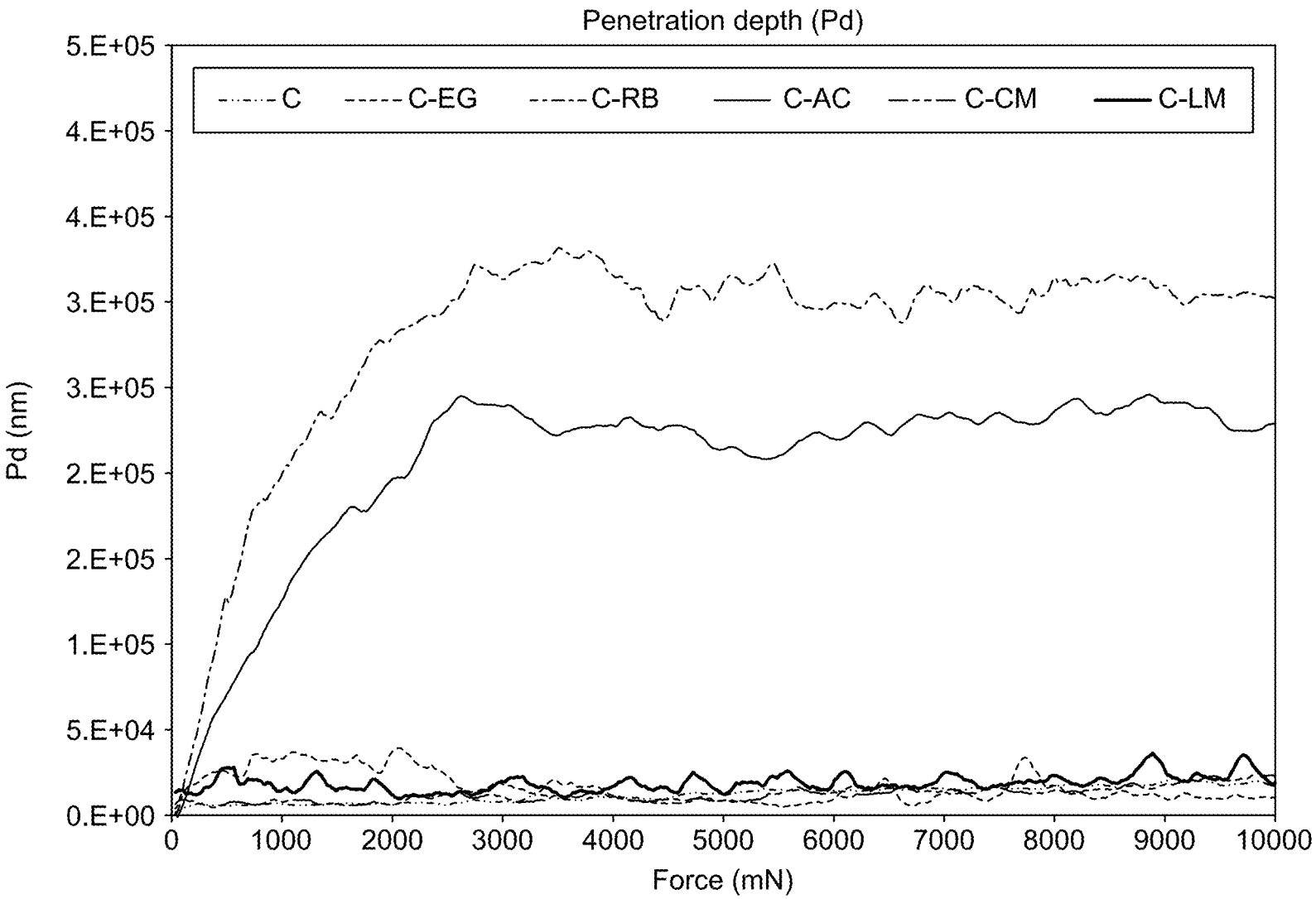
FIG. 7A shows penetration depth plots of unmodified (C) and modified coating matrices (C-AC, C-CM, C-EG, C-LM, and C-RB) on mild steel surfaces, according to certain embodiments.
Figure 7B:
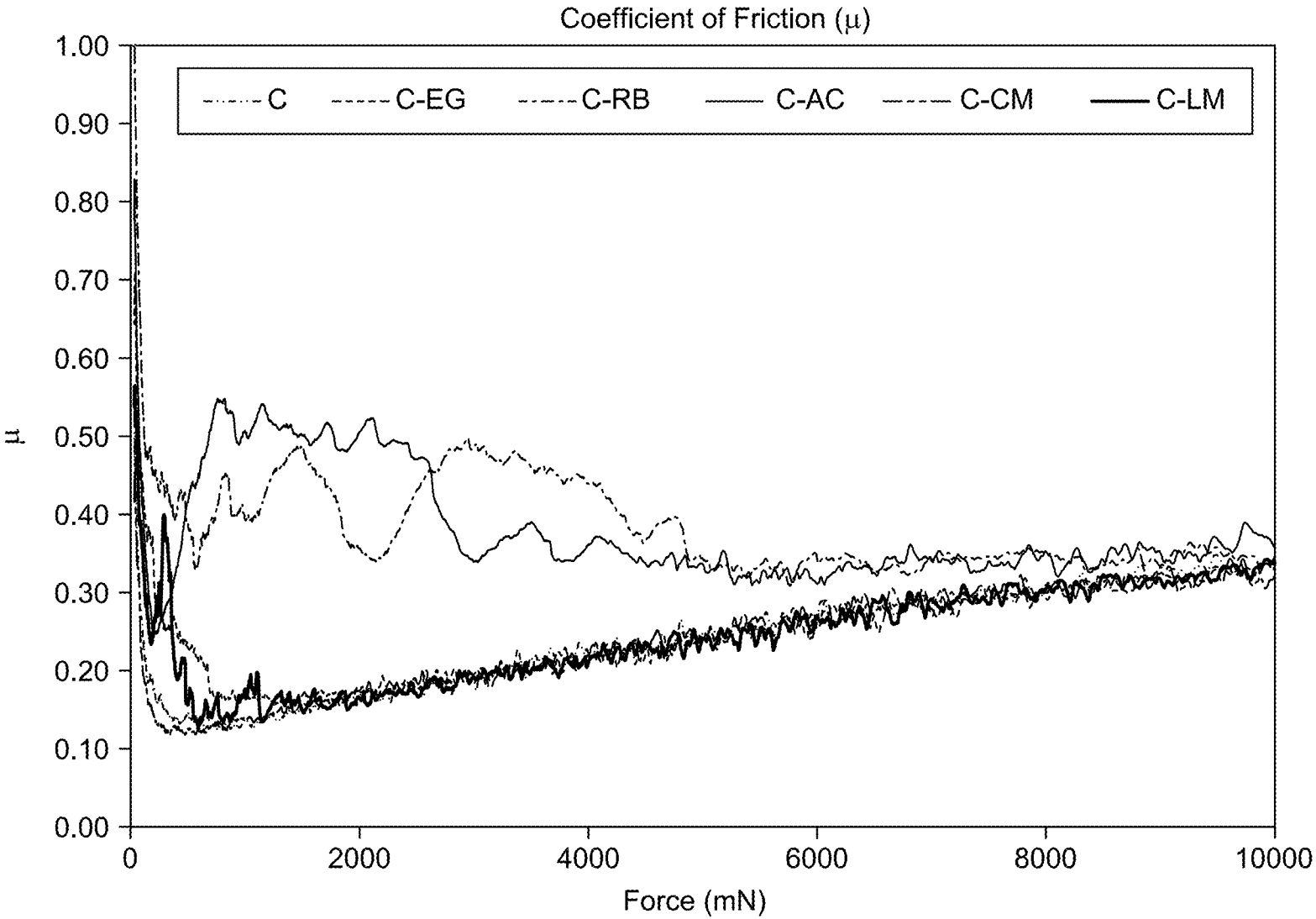
FIG. 7B shows coefficient of friction plots of unmodified and modified coating matrices on mild steel surfaces, according to certain embodiments.

The scratch resistance properties of all the coating matrices on steel were also examined to evaluate and compare the degree of adhesion and the presence of any coating's delamination or cracking behaviors in the coated films. FIG. 7A shows penetration depth plots, while FIG. 7B shows the coefficient of friction plots of unmodified and modified coating matrices on mild steel surfaces, respectively. Any increase in the penetration depth is usually associated with an increase in the critical load. This is evident with the waste-loaded coatings that showed higher critical load values compared with the parent coating, which reveals an enhancement in the degree of bonding these coating formulations to the steel surface. This result reflects an advantageous aspect of modifying the developed hybrid sol-gel coatings with the waste additive. As the penetration is increased, a larger area of the coating material is exposed to the scratching force, making it more susceptible to damage. Samples C-CM, C-EG, and C-RB demonstrated comparable and relatively low $L_c$ values indicating less compatibility between these additives and the hybrid polymer matrix.

Figure 8A:
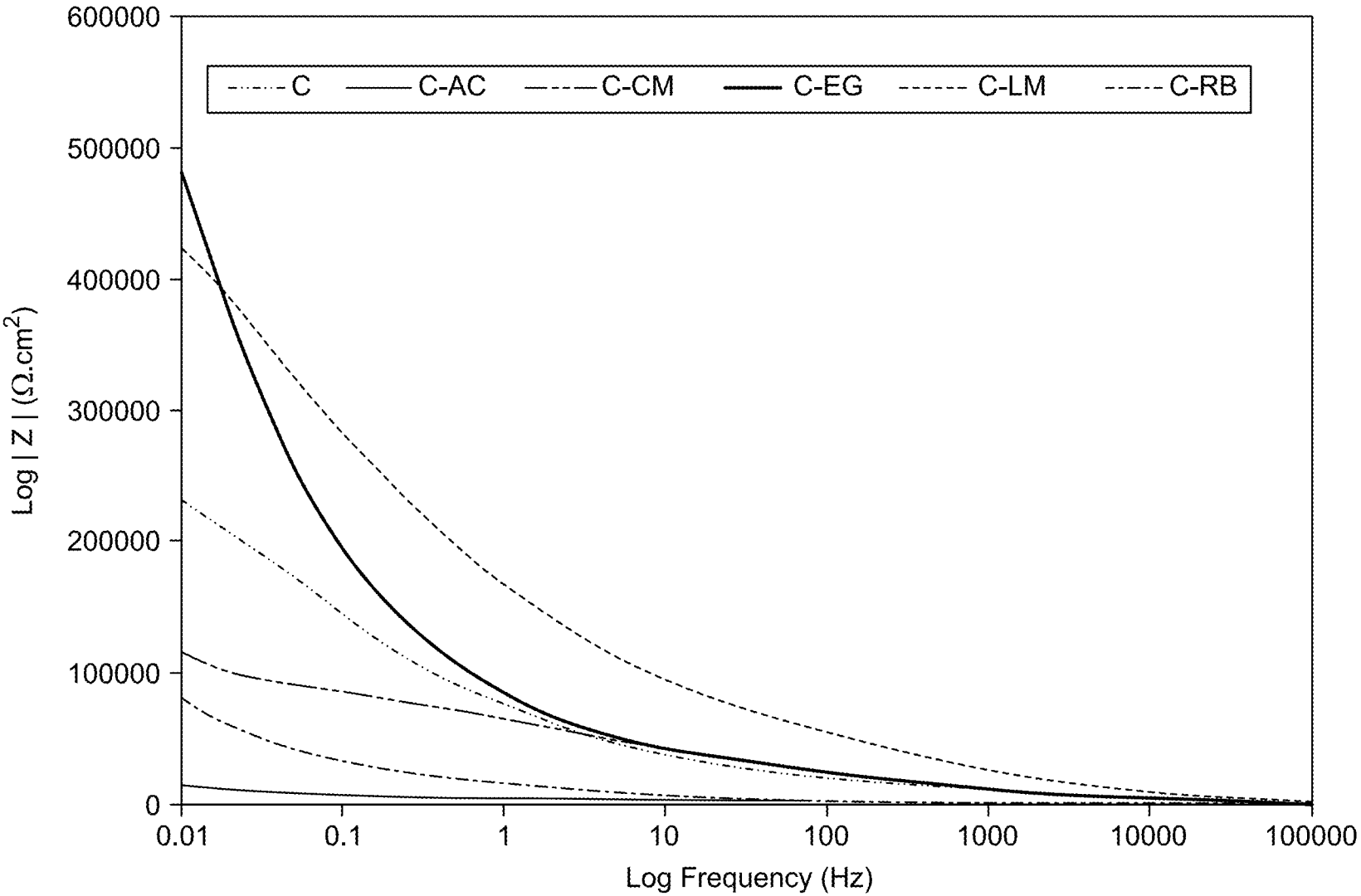
FIG. 8A shows Bode plots of all coated samples, namely, C, C-AC, C-CM, C-EG, C-LM, and C-RB, on the mild steel substrate after 24 h of exposure to the 3.5 wt. % NaCl solution, according to certain embodiments.
Figure 8B:
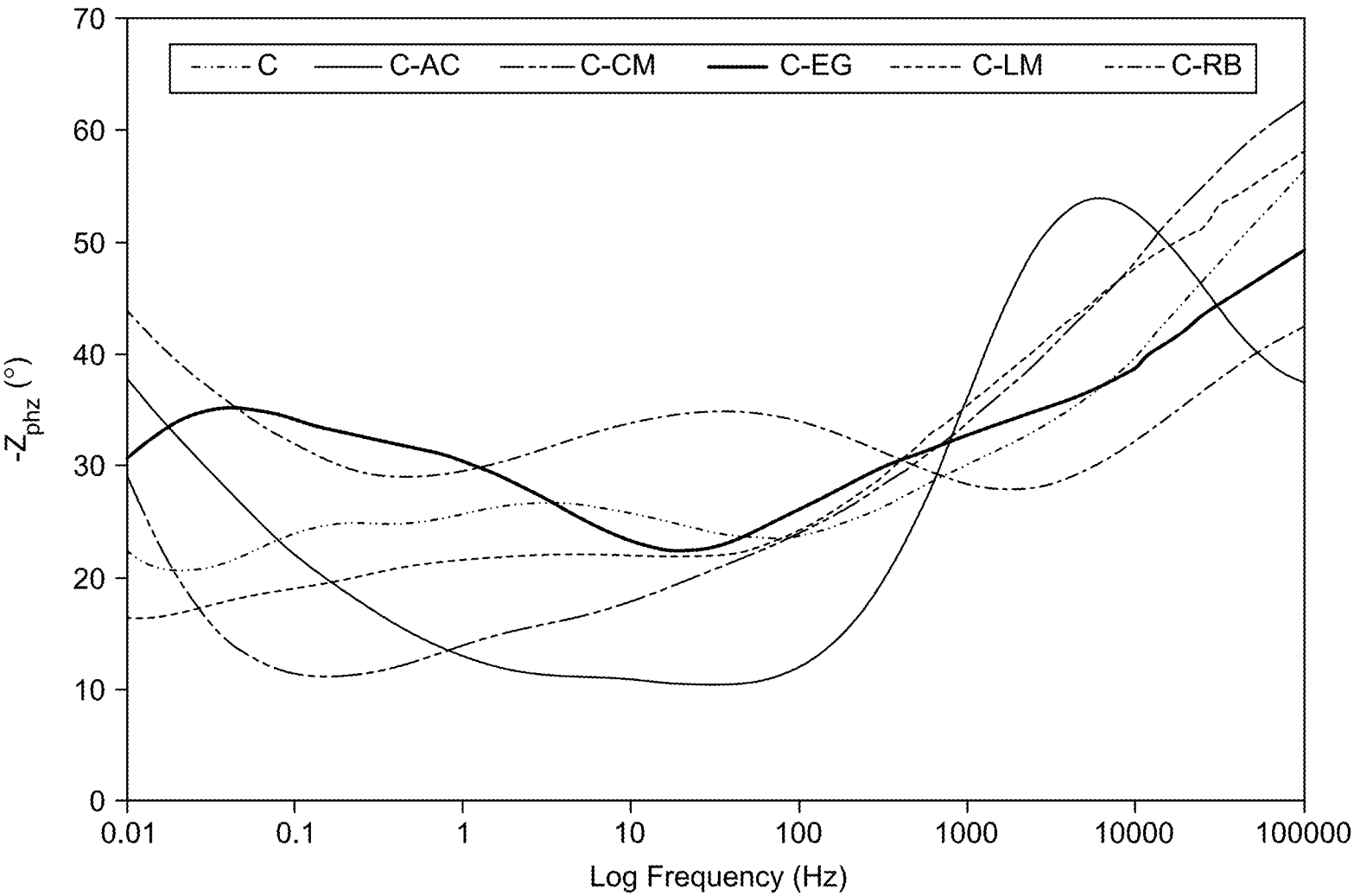
FIG. 8B shows Bode-phase plots of all the coated samples namely, C, C-AC, C-CM, C-EG, C-LM, and C-RB, on the mild steel substrate after 24 h of exposure to the 3.5 wt. % NaCl solution, according to certain embodiments.
Figure 8C:
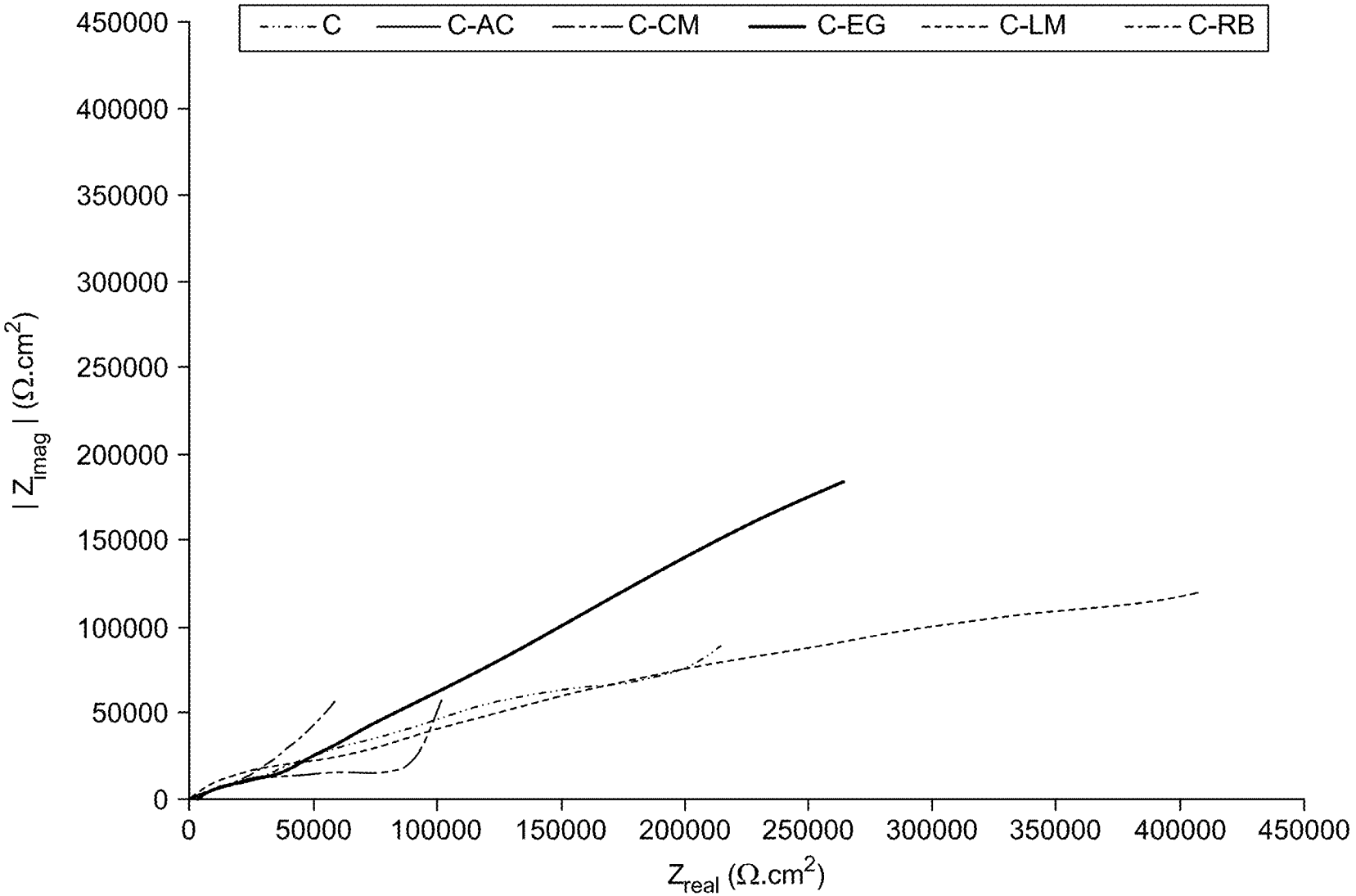
FIG. 8C shows Nyquist plots of all the coated samples, namely, C, C-AC, C-CM, C-EG, C-LM, and C-RB, on the mild steel substrate after 24 h of exposure to the 3.5 wt. % NaCl solution, according to certain embodiments.

The corrosion protection performances of the parent and waste-modified coating matrices on steel panels were assessed by exposing them continuously to 3.5 wt. % NaCl corrosive medium, followed by electrochemical and visual observation tests. The bode, bode-phase, and Nyquist electrochemical impedance spectroscopy (EIS) of the steel-coated samples after 24 h are shown in FIG. 8A-8C while the bode, bode-phase, and Nyquist EIS plots of the steel-coated samples after 4 weeks of exposure to the saline medium are presented in FIG. 9A-9C, respectively. EIS is a technique used to characterize the electrical properties of materials and, more commonly, in studying the corrosion of metals and coatings.

Figure 8D:
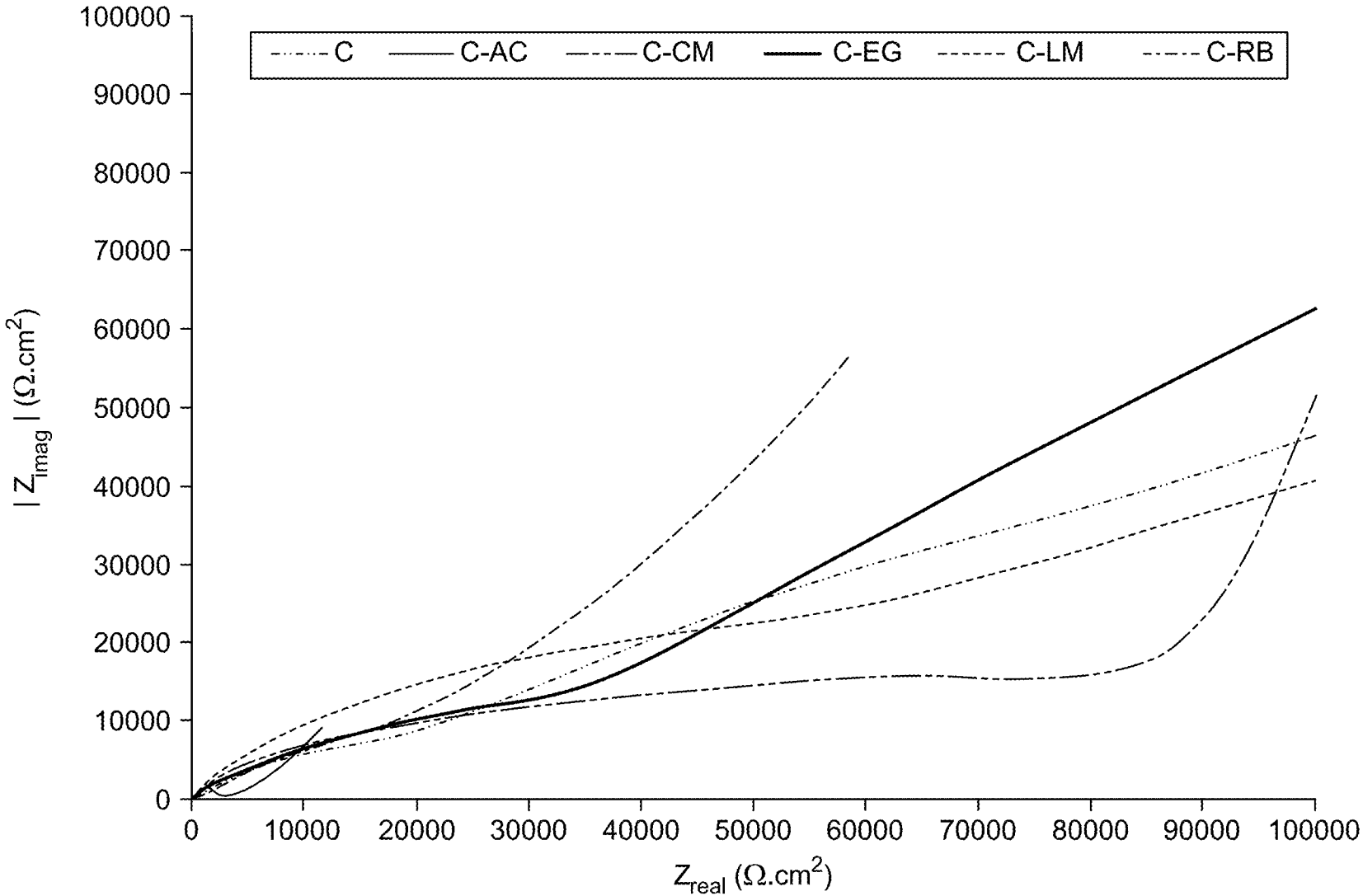
FIG. 8D shows an enlarged high-frequency region of Nyquist curves after 24 h of exposure to the 3.5 wt. % NaCl solution, according to certain embodiments.

At early times of immersion in the saline medium, the samples loaded with the limestone (C-LM) and eggshell (C-EG) showed higher impedance values than those for the parent hybrid coating (FIG. 8A and FIG. 8B), which indicates enhanced barrier properties as a result of the modification step with the aforementioned two waste additives. This enhancement is also proved by the presence of wider semicircles in the EIS Nyquist plots of the two waste-modified samples compared with the unmodified one (FIG. 8C). To achieve a clearer visualization of the EIS behavior of the coated samples, the high-frequency region of the Nyquist curves was further enlarged (FIG. 8D). An increase in the impedance values in the EIS Bode and the width of the semicircles in the Nyquist plots revealed an enhanced corrosion protection performance for hybrid sol-gel coatings. Still, an acceptable corrosion protection performance was achieved for the other waste-functionalized samples considering their high obtained impedance values (about $10^5$ $\Omega \cdot cm^2$) after 24 h of immersion.

Figure 9A:
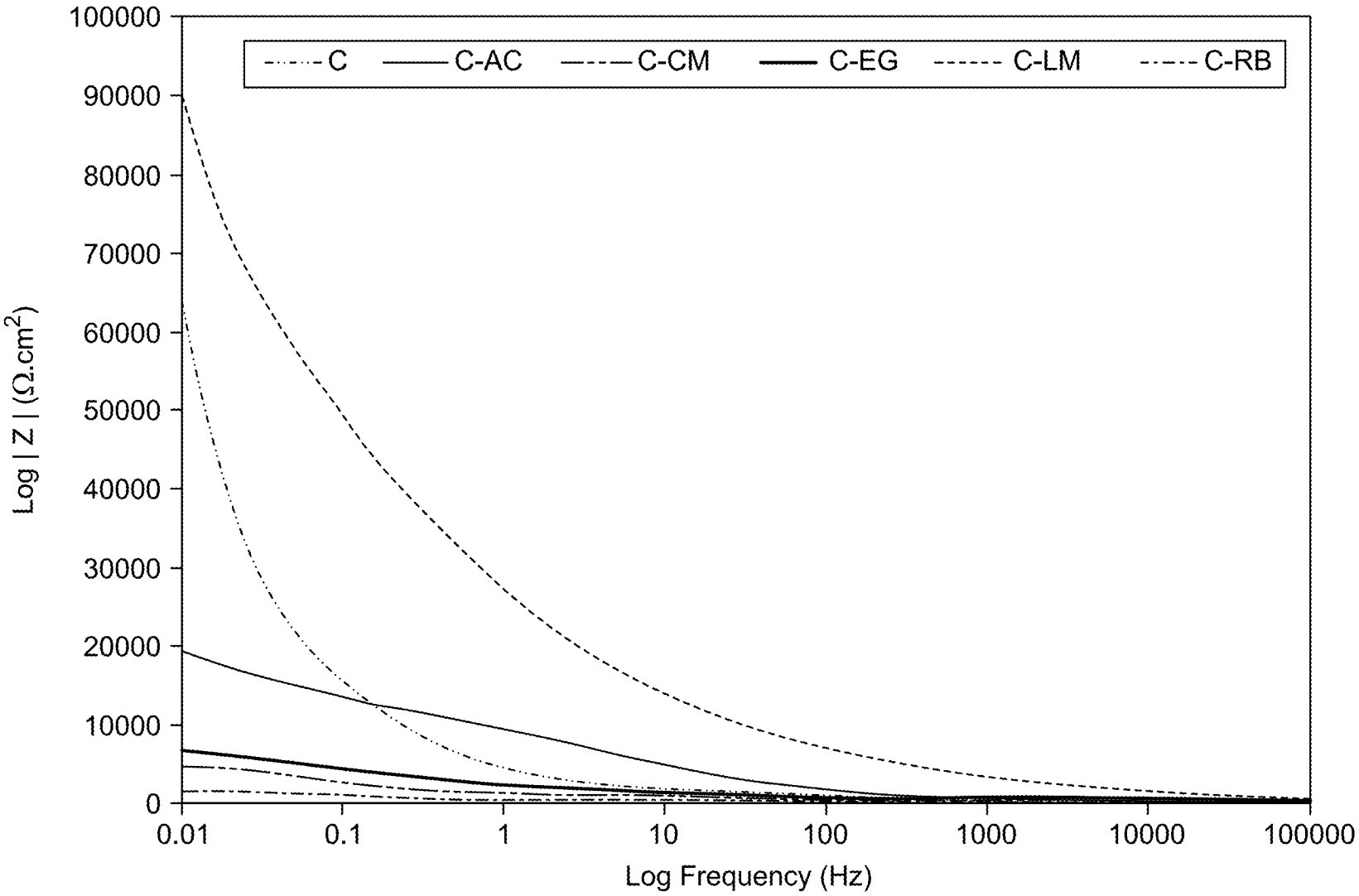
FIG. 9A shows Bode-resistance plots of all the coated samples, namely, C, C-AC, C-CM, C-EG, C-LM, and C-RB, on the mild steel substrate after 4 weeks of exposure to the 3.5 wt. % NaCl solution, according to certain embodiments.
Figure 9B:
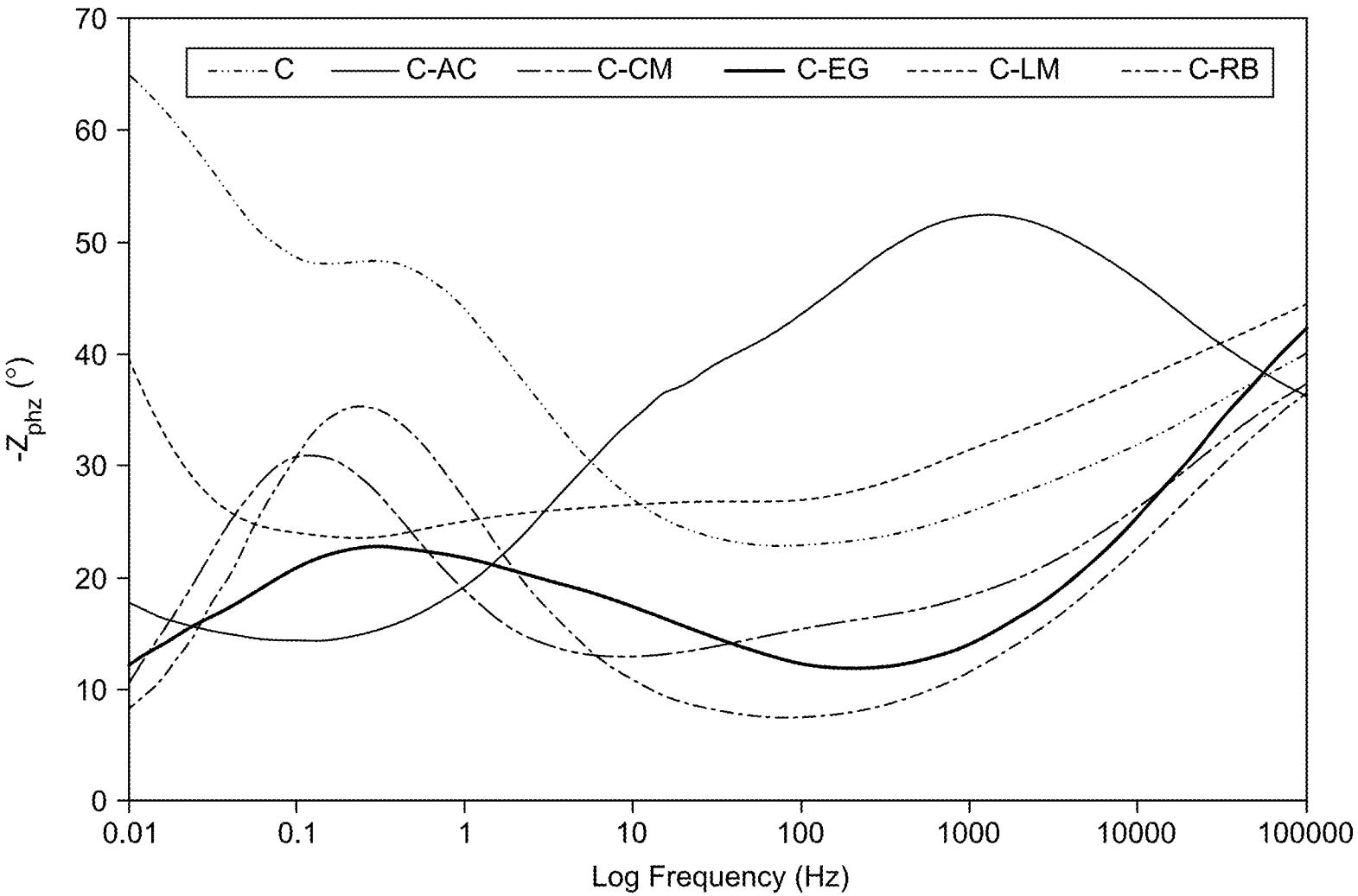
FIG. 9B shows Bode-phase plots of all the coated samples, namely, C, C-AC, C-CM, C-EG, C-LM, and C-RB, on the mild steel substrate after 4 weeks of exposure to the 3.5 wt. % NaCl solution, according to certain embodiments.
Figure 9C:
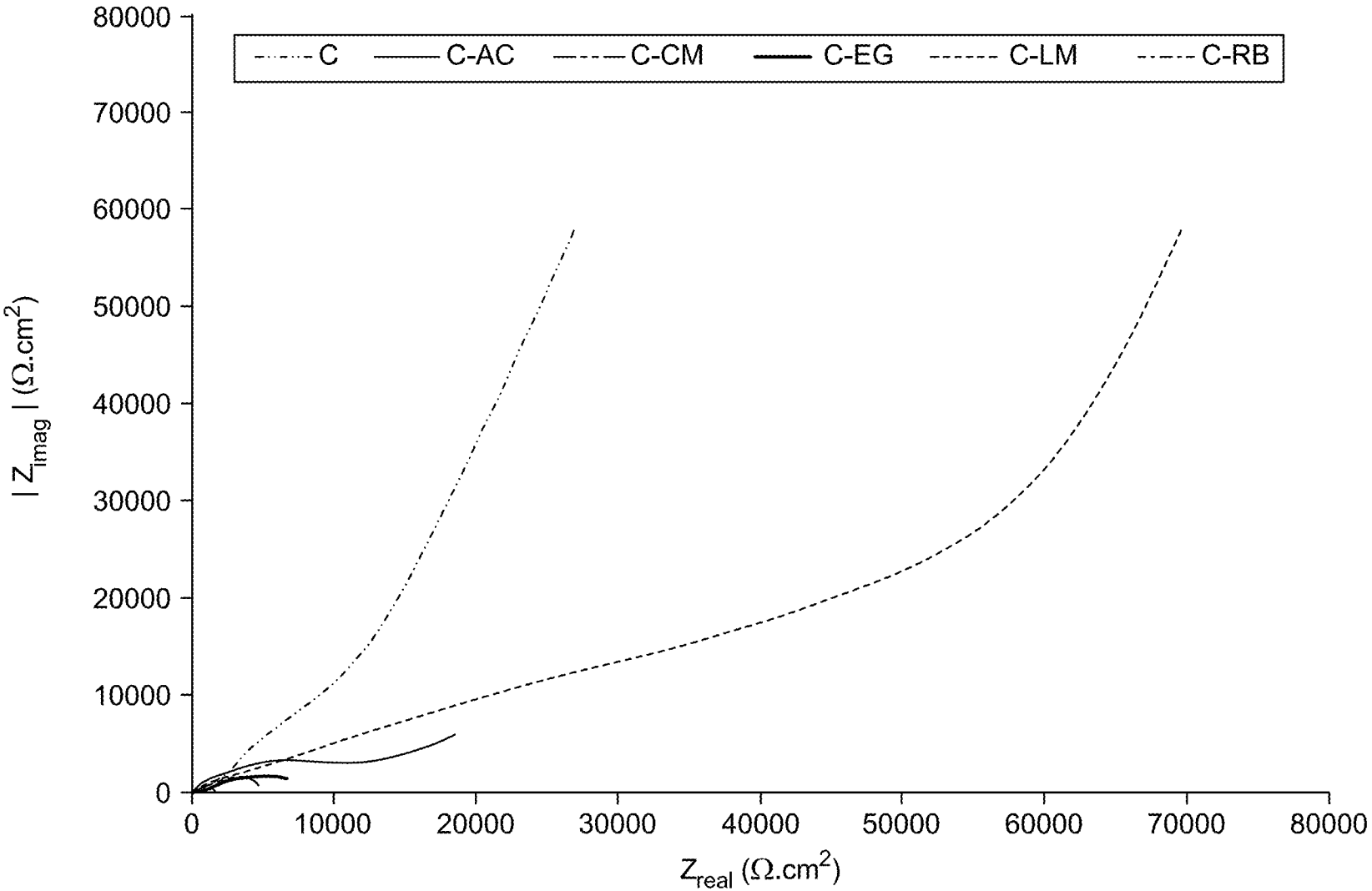
FIG. 9C shows Nyquist plots of all the coated samples, namely, C, C-AC, C-CM, C-EG, C-LM, and C-RB, on the mild steel substrate after 4 weeks of exposure to the 3.5 wt. % NaCl solution, according to certain embodiments.
Figure 9D:
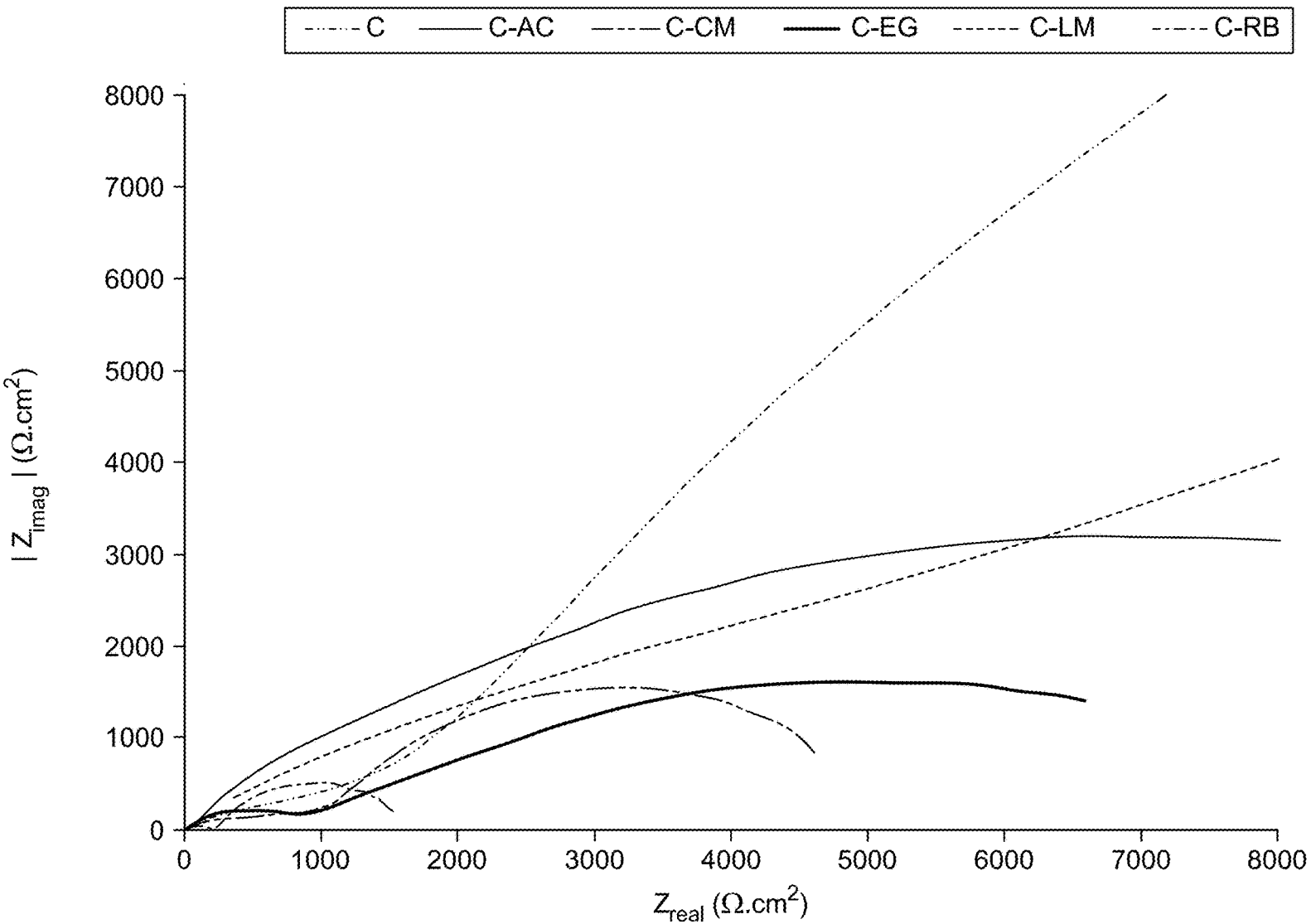
FIG. 9D shows the enlarged high-frequency region of the Nyquist curves after 4 weeks of exposure to the 3.5 wt. % NaCl solution, according to certain embodiments.

The impact of the waste additives on the corrosion-resistance performance of the parent hybrid sol-gel coating at prolonger immersion times was deduced from the EIS data plotted in FIG. 9A-9C. The Bode-phase (FIG. 9B) and Nyquist (FIG. 9C) plots and enlarged Nyquist plots (FIG. 9D) of the EIS data of all steel-coated samples showed the presence of 3-time constants. The one in the high-frequency range corresponds to the behavior of the hybrid film, the one in the middle-frequency range corresponds to the behavior of the oxide layer on the surface, and the last one at low frequencies corresponds to the interphase behavior with the metal surface. The EIS plots demonstrate that only sample C-LM has positively affected the barrier properties of the neat parent hybrid coating. The lower impedance values of the remaining modified samples compared with the unmodified coating indicates a deterioration in the barrier properties of these coating systems on the steel surface after 4 weeks of immersion in the saline medium. It can be seen from the plots that the corrosion protection performance of the parent hybrid polymer was found to give the worst behavior after its functionalization with the tire rubber additive indicating the lack of any synergy between the two components.

Figure 10A:
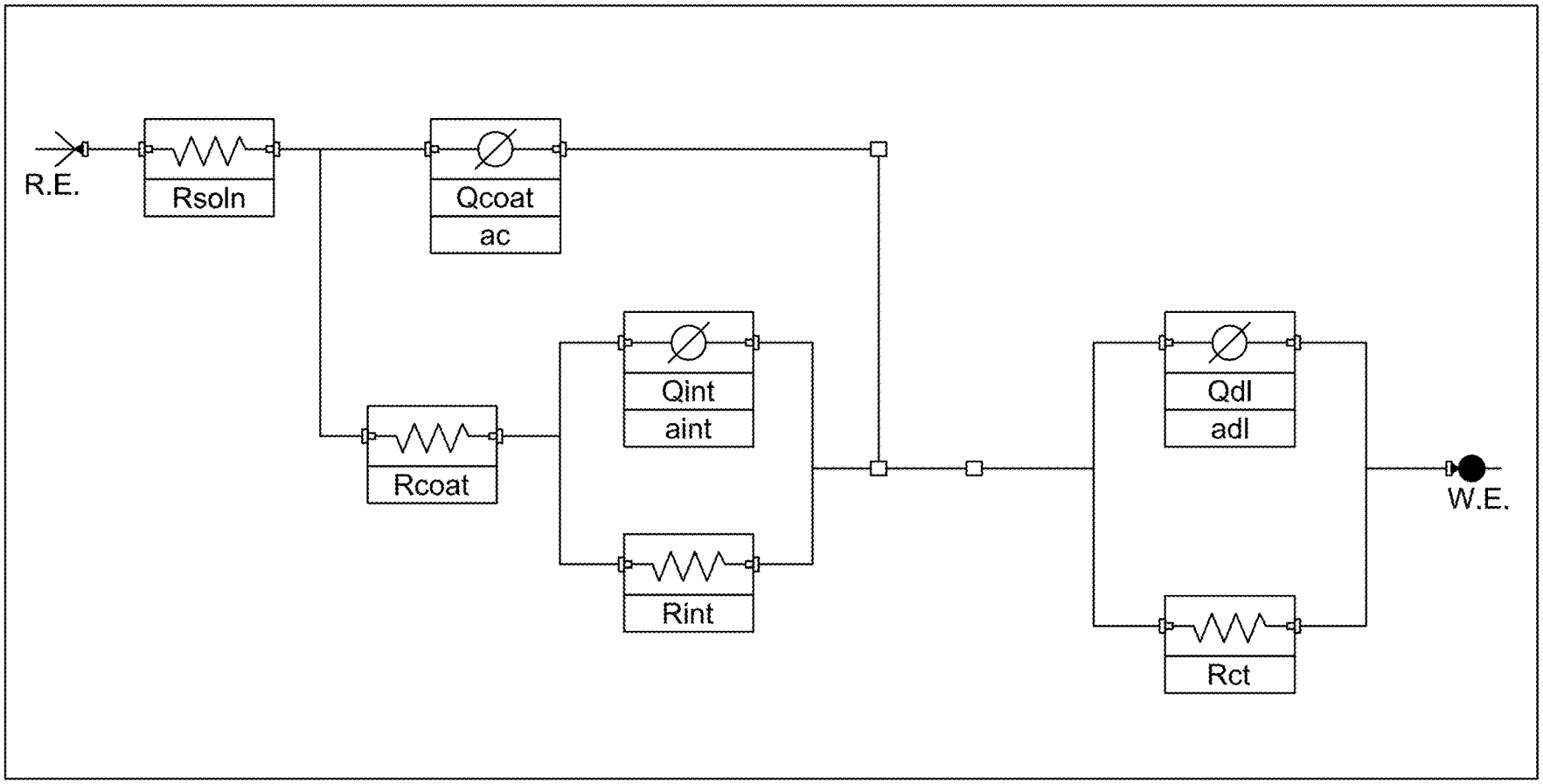
FIG. 10A-FIG. 10B shows electrochemical equivalent circuits used to fit electrochemical impedance spectroscopy (EIS) data of the coating matrices on the mild steel substrate, according to certain embodiments.
Figure 10B:
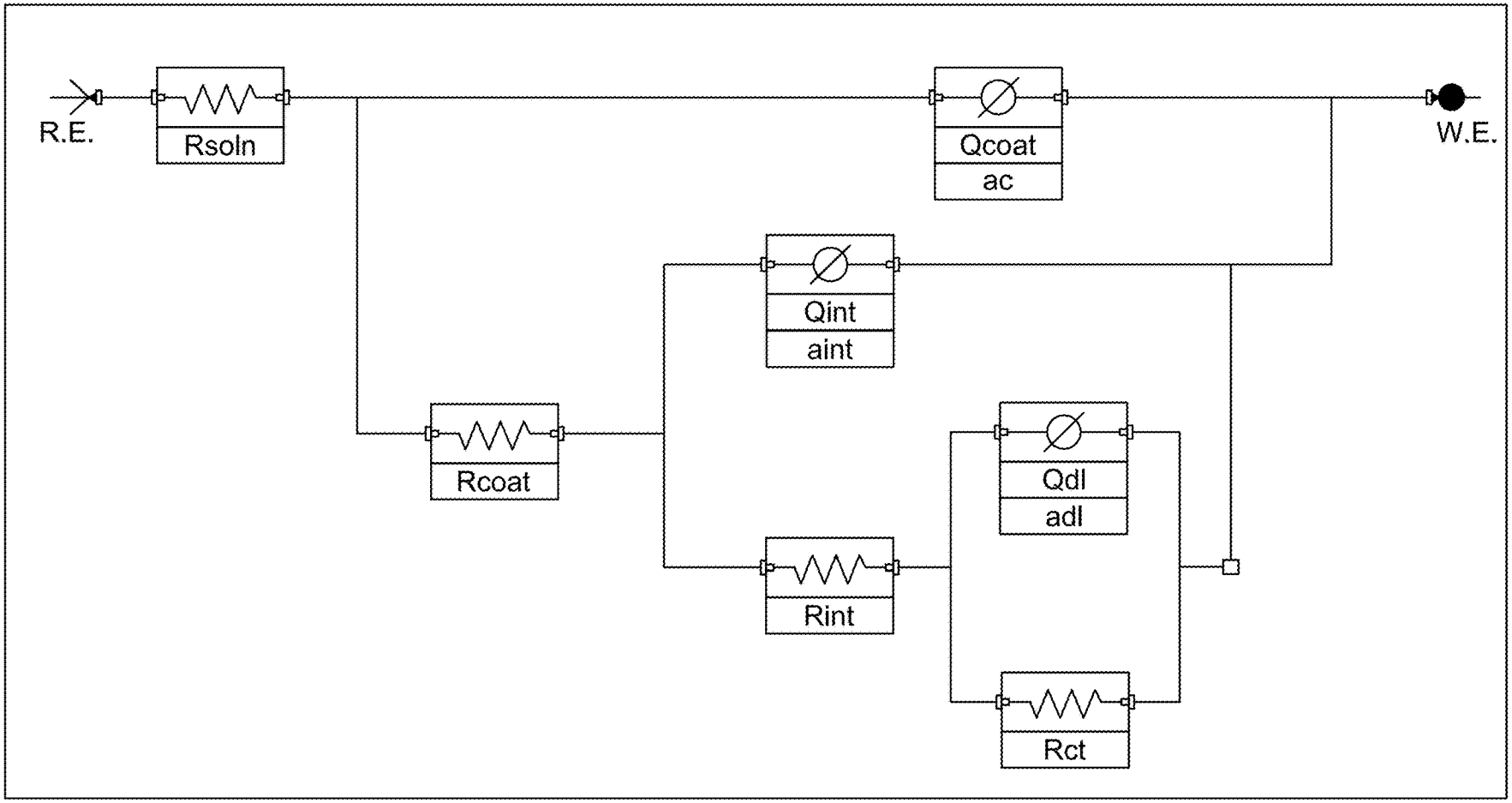

The experimental EIS data of all steel-coated samples were further modeled using the equivalent circuit (EC) models shown in FIGS. 10A-10B and the obtained fitting results are also listed in Table 4. The ECs involve a solution resistance ($R_s$), a time constant of coating containing a resistance ($R_{coat}$) and a constant phase element ($Q_{coat}$) at high frequencies, and a time constant attributed to the charge transfer resistance of the metal ($R_{ct}$) and a double-layer constant phase element ($Q_{d1}$) at low frequencies. The quality of fitting was judged based on the obtained chi-square ($\chi^2$) value for each EC; a value of $10^{-3}$ for $\chi^2$ and lower refers to excellent fitting. Circuit A was found to be suitable for fitting the EIS data of all samples at the two immersion times, except for samples C-EG and C-LM, in which Circuit B was found to give the best fit for the two sets of data after 4 weeks of immersion. In the circuits, the capacitor component was replaced with a constant-phase element (CPE, ø) was considered in the circuits to account for the non-perfect capacitive behavior of the coating as a result of double layers inhomogeneity or non-uniformity in coating thickness. The Qdl and Rct elements are used to rank the corrosion resistance performance of coated samples on metal surfaces. The relatively high resistance and low capacitance values of sample C-LM after 4 weeks of immersion (Table 3) reveal a more robust corrosion protection performance for this coating formulation than the other developed coating formulations in this work. Moreover, the low $R_{coat}$ values of all waste-embedded samples (the highest value is for C-LM) indicates the presence of high porosity, water absorption, and coating degradation in these samples. Still, sample C-LM suffered from a reduction in its $R_{coat}$ value, which is thought to occur as a function of immersion time. Any increase in this parameter may result from the blockage of defects or pores by corrosion products. Overall, the rank of the corrosion protection performance of the developed coating systems is C-LM>C>C-AC>C-EG>C-CM>C-RB.

Figure 11:
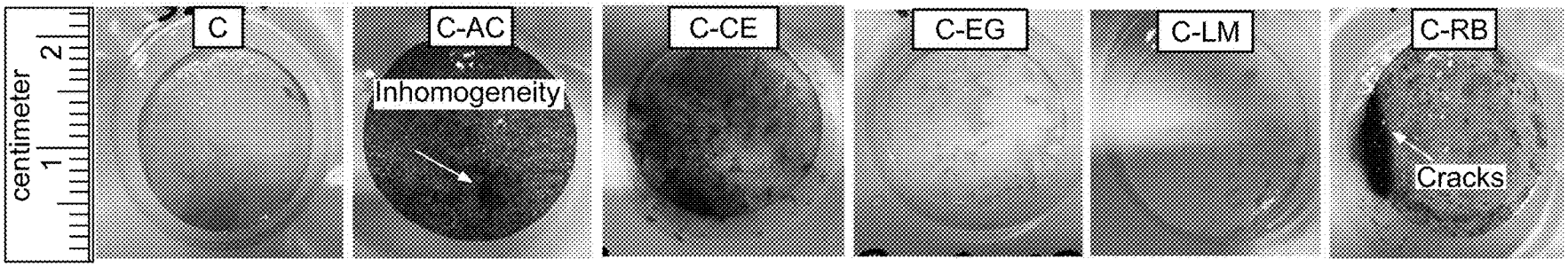
FIG. 11 shows pictures of the mild steel-coated samples, (samples C, C-AC, C-CM, C-EG, C-LM, and C-RB, coated on the mild steel substrate) after exposure to the 3.5 wt. % NaCl for 4 weeks, according to certain embodiments.

FIG. 11 are images of the parent and waste-modified steel-coated matrices after four weeks of exposure to the saline medium. The images illustrate a small number of cracks/defects in the coating layers of samples C-CE and C-RB, which explains their low barrier properties reported above. Opposite to this, the surfaces of the parent coating "C" and the waste-modified samples C-EG and C-LM were intact, with no defects or delamination phenomena, indicating an appreciated corrosion-resistance behavior for the two samples. Moreover, the observed inhomogeneity in C-AC remained linked and integrated after the exposure test. Overall, the visual observation results showed agreement with the electrochemical and morphological testing results as reported earlier.

A synergetic effect was achieved for a hybrid sol-gel composite coating on its structural, thermal, mechanical, morphological, scratch-resistance, and barrier properties for protecting mild steel substrates in a 3.5 wt. % NaCl medium, when loading with a limestone additive. On the other hand, not all additives achieved these improved results, and the properties depend on the type, amount, and distribution of the additives, as well as the synthesis and processing conditions of the hybrid sol-gel system.

Numerous modifications and variations of the present invention are possible in light of the above teachings. It is therefore, to be understood that within the scope of the appended claims, the invention may be practiced otherwise than as specifically described herein.

The invention claimed is:

1. A method of reducing corrosion, comprising:

coating a surface of a substrate with a corrosion inhibitor and drying to form a coated substrate, wherein the coated substrate when contacted with a corrosive medium has a charge transfer resistance (Rct) of at least 2,000 kΩ, wherein the corrosion inhibitor comprises:

TABLE 4

Fitted parameter values of C-coated samples using EC as presented in FIG. 10.

| Immersion Time | Parameter | Sample C | C-AC | C-CM | C-EG | C-LM | C-RB |
|---|---|---|---|---|---|---|---|
| 24 h | Rsoln (Ω) | 46.1 | 10.0 | 19.1 | 10.0 | 5.0 | 10.0 |
| | Rcoat (kΩ) | 39.91 | 4.83 | 72.58 | 4.05 | 35.36 | 0.67 |
| | Qcoat (μF $cm^{-2}$ $s^{-(1-\alpha c)}$) | 3.27 | 90.04 | 2.92 | 0.045 | 0.075 | 1.39 |
| | acoat | 0.5 | 0.3 | 0.5 | 0.7 | 0.6 | 0.6 |
| | Rint (MΩ) | 14.93 | 3.77 | 0.19 | 0.024 | 0.9 | 13.9 |
| | Qint (μF $cm^{-2}$ $s^{-(1-\alpha c)}$) | 7.11 | 257.90 | 170.30 | 1.16 | 3.29 | 77.19 |
| | aint | 0.2 | 0.6 | 0.9 | 0.5 | 0.3 | 0.6 |
| | Rct (kΩ) | 10.93 | 1.79 | 16.79 | $2.03 \times 10^3$ | $2.16 \times 10^3$ | 22.42 |
| | Qdl (μF $cm^{-2}$ $s^{-(1-\alpha c)}$) | 0.25 | 0.12 | 0.16 | 6.68 | 139.00 | 18.82 |
| | adl | 0.6 | 0.9 | 0.7 | 0.5 | 0.8 | 0.5 |
| | $\chi^2$ ($\times 10^3$) | 1.68 | 0.22 | 0.067 | 0.14 | 0.21 | 0.059 |
| | Circuit | A | A | A | A | B | A |
| 4 Weeks | Rsoln (Ω) | 14.0 | 15.0 | 20.0 | 15.0 | 15.0 | 10.6 |
| | Rcoat (kΩ) | 1.19 | 0.30 | 0.24 | 0.92 | 4.92 | 0.11 |
| | Qcoat (μF $cm^{-2}$ $s^{-(1-\alpha c)}$) | 20.02 | 2.09 | 1.31 | 2.74 | 1.68 | 2.25 |
| | acoat | 0.5 | 0.9 | 0.7 | 0.6 | 0.5 | 0.7 |
| | Rint (kΩ) | $10.37 \times 10^3$ | 132.90 | 1.06 | 0.12 | 129.20 | 0.13 |
| | Qint (μF $cm^{-2}$ $s^{-(1-\alpha c)}$) | 225.90 | 349.2 | 160.80 | 3.07 | 16.33 | 435.90 |
| | aint | 0.9 | 0.4 | 0.4 | 0.9 | 0.4 | 0.4 |
| | Rct (kΩ) | 20.94 | 11.29 | 3.900 | 8.39 | $2.51 \times 10^3$ | 1.44 |
| | Qdl (μF $cm^{-2}$ $s^{-(1-\alpha c)}$) | 88.48 | 17.43 | 715.00 | 232.10 | 99.11 | $1.26 \times 10^3$ |
| | adl | 0.6 | 0.6 | 0.8 | 0.5 | 0.9 | 0.8 |
| | $\chi^2$ ($\times 10^3$) | 1.32 | 0.28 | 0.021 | 0.28 | 0.15 | 0.16 |
| | Circuit | A | A | A | B | B | A |

a sol-gel; and limestone, wherein the sol-gel comprises reacted units of aminopropyltriethoxysilane (APTES), tetraethyl orthosilicate (TEOS), dimethoxy-methyl-octadecylsilane (DMMOS), vinyltrimethoxysilane (VTMS), and zirconium (IV) propoxide.

2. The method of claim 1, wherein the corrosion inhibitor further comprises at least one additive selected from the group consisting of eggshells, activated carbon, rubber, and cement kiln dust.

3. The method of claim 1, wherein the limestone is a powder, and wherein particles of the powder have an average size of 1-10 μm.

4. The method of claim 1, wherein the corrosion inhibitor comprises 0.01-1 g of the limestone per mL of the sol-gel.

5. The method of claim 1, wherein the limestone is uniformly dispersed in the corrosion inhibitor on the coated substrate.

6. The method of claim 1, wherein the sol-gel comprises 15-25 mol % APTES, 15-25 mol % TEOS, 10-20 mol % DMMOS, 25-35 mol % VTMS, and 1-5 mol % zirconium (IV) propoxide, based on a total number of moles in the sol-gel.

7. The method of claim 1, wherein corrosion inhibitor is stable up to 425° C.

8. The method of claim 1, wherein corrosion inhibitor forms a uniform and continuous layer on the coated substrate.

9. The method of claim 1, wherein corrosion inhibitor does not comprise water, free hydroxyl groups, or hydrogen bonds after the drying.

10. The method of claim 1, wherein the drying is for 1-24 hours at a temperature of 20-200° C.

11. The method of claim 1, wherein the corrosion inhibitor has an average thickness of 10 to 100 μm on the coated substrate.

12. The method of claim 1, wherein the coated substrate has a water contact angle (WCA) of greater than 135°.

13. The method of claim 1, wherein the coated substrate has an average surface roughness of 1.5-2.5 μm.

14. The method of claim 1, wherein the coated substrate has an indentation hardness (HIT) at 50 mN of at least 10 MPa.

15. The method of claim 1, wherein the corrosion inhibitor does not comprise chromium or phosphate.

16. The method of claim 1, wherein the substrate is made from at least one material selected from the group consisting of mild steel, carbon steel, stainless steel, iron, copper, nickel, and alloys thereof.

17. The method of claim 1, wherein the corrosive medium comprises an aqueous solution comprising at least one salt selected from the group consisting of an alkali metal salt, and an alkaline earth metal salt.

18. The method of claim 1, wherein the corrosive medium has a temperature of 30-70° C.

19. The method of claim 1, wherein the corrosion inhibitor increases the Rct by at least 10 times compared to a same method but without the limestone.

20. The method of claim 1, wherein the Ret is measured following contacting the coated substrate with the corrosive medium for at least 24 hours.

* * * * *